US007549601B2

(12) United States Patent
Horiguchi et al.

(10) Patent No.: US 7,549,601 B2
(45) Date of Patent: Jun. 23, 2009

(54) LEVEL WOUND COIL MOUNTED ON PALLET, AND PACKAGE FOR SAME

(75) Inventors: Ken Horiguchi, Tsuchiura (JP); Yusuke Takenaga, Inashikigun (JP); Katsumi Nomura, Tsuchiura (JP); Mamoru Hofuku, Inashikigun (JP); Kenichi Inui, Inashikigun (JP); Tomo Kawano, Ishioka (JP)

(73) Assignee: Hitachi Cable, Ltd., Tokyo (JP)

( * ) Notice: Subject to any disclaimer, the term of this patent is extended or adjusted under 35 U.S.C. 154(b) by 578 days.

(21) Appl. No.: 11/373,525

(22) Filed: Mar. 13, 2006

(65) Prior Publication Data

US 2006/0201839 A1 Sep. 14, 2006

(30) Foreign Application Priority Data

Mar. 14, 2005 (JP) ..... 2005-071743
Feb. 15, 2006 (JP) ..... 2006-038657

(51) Int. Cl.
*B65H 55/04* (2006.01)

(52) U.S. Cl. ..... 242/174; 242/476.7

(58) Field of Classification Search ..... 242/174–178, 242/476.7, 478.1, 484, 484.1, 484.4; 108/56.3, 108/52.1, 51.11
See application file for complete search history.

(56) References Cited

U.S. PATENT DOCUMENTS 5,193,761 A * 3/1993 Fritz et al. ..... 242/159
6,502,700 B2 1/2003 Goosetree

FOREIGN PATENT DOCUMENTS

| | | |
|---|---|---|
| JP | 5-139620 | 6/1993 |
| JP | 2002-370869 | 12/2002 |
| JP | 2004-2012 | 1/2004 |

OTHER PUBLICATIONS

Japanese Office Action dated Jul. 24, 2007 with English translation.

* cited by examiner

*Primary Examiner*—Peter M Cuomo
*Assistant Examiner*—William E Dondero
(74) *Attorney, Agent, or Firm*—McGinn IP Law Group, PLLC

(57) ABSTRACT

A level wound coil (LWC) mounted on pallet having; an LWC having a plurality of coil layers each of which has a pipe wound in alignment winding and in traverse winding; and a pallet on which the one or more LWC is mounted or on which the one or more LWC is mounted through a cushioning material. The LWC has a shift section where the pipe is shifted from the m-th coil layer to the (m+1)-th coil layer on a bottom surface thereof when the LWC is disposed on the mount surface. A start point of a (k+1)-th shift section does not transit, relative to a start point of a k-th shift section, in a reverse direction to a winding direction of the pipe. The pallet or the cushioning material has a recessed area that is formed at all or a part of a portion of the pallet or the cushioning material to face the (k+1)-th shift section not transiting in the reverse direction.

10 Claims, 22 Drawing Sheets

LEVEL WOUND COIL MOUNTED ON PALLET, AND PACKAGE FOR SAME

The present application is based on Japanese patent application Nos. 2005-71743 and 2006-38657 filed Mar. 14, 2005 and Feb. 15, 2006, respectively, the entire contents of which are incorporated herein by reference.

BACKGROUND OF THE INVENTION

1. Field of the Invention

This invention relates to a level wound coil (hereinafter called LWC) mounted on pallet and, particularly, to an LWC mounted on a pallet in which the LWC is formed winding a metal pipe, such as a copper and copper alloy pipe, which is used as a heat transfer pipe of an air-conditioning heat exchanger, a water pipe etc. Furthermore, this invention relates to a package for the LWC mounted on pallet.

2. Description of the Related Art

A heat transfer pipe such as an inner grooved tube/pipe and a smooth (plain) tube/pipe is used for the air-conditioning heat exchanger, the water pipe etc. The heat transfer pipe is typically formed of a copper or copper alloy pipe (hereinafter simply called copper pipe). In the manufacturing process thereof, the pipe is coiled and then annealed into a given tempered material. Then, it is stored or transported in the form of LWC. In use, the LWC is uncoiled and cut into a pipe with a desired length.

When the LWC is used, the copper pipe is fed out from the LWC by using a copper pipe feeding apparatus (uncoiler). For example, JP-A-2002-370869 discloses a copper pipe feeding apparatus, which will be explained below.

FIG. 15A is a perspective view showing a conventional copper pipe feeding apparatus (vertical uncoiler). FIG. 15B is a perspective view showing a conventional copper pipe feeding apparatus (horizontal uncoiler).

As shown in FIG. 15A, the copper pipe feeding apparatus 10A is operated such that a bobbin 21 with an LWC 20 coiled around there is vertically attached, and a copper pipe 22 is fed from the bobbin 21 while being guided by a guide 11 in a feeding direction. Then, it is cut into a pipe with a desired length by a cutter (not shown).

As shown in FIG. 15B, the copper pipe feeding apparatus 10B is operated such that the bobbin 21 with the LWC 20 coiled around there is horizontally disposed on a turntable 12, and the copper pipe 22 is fed from the bobbin 21 while being guided by a guide 13 in a feeding direction. Then, it is cut into a pipe with a desired length by a cutter (not shown).

FIG. 16 is a cross sectional view showing a detailed arrangement of an LWC coiled around the bobbin in FIG. 15A or 15B. As shown in FIG. 16, the LWC 20 is structured with the copper pipe coiled around the bobbin 21. The bobbin 21 comprises an inner cylinder 23 around which the copper pipe 22 is coiled in multiple layers, and a pair of disk-like sideboards 24 attached to both sides of the inner cylinder 23.

However, the copper pipe feeding apparatuses 10A, 10B as shown in FIGS. 15A and 15B have a problem that the structure is complicated and the cost thereof increases.

In order to solve this problem, JP-A-2002-370869 discloses a copper pipe feeding method called "Eye to the sky" (hereinafter called ETTS), which may be also called "Inner end payoff (or ID payoff)"

FIG. 17 is a perspective view showing the method of feeding a copper pipe by the ETTS method. An LWC mounted on pallet 30 (herein also called LWC assembly when plural LWC's are stacked) has plural LWC's 32 that are stacked through a cushioning material 33 such that its center axis is directed perpendicularly to the upper surface of a pallet 31. The pallet 31 is usually formed rectangular and comprises plural wooden square logs 31*a* and one or more wooden board 31*b* attached on the square logs 31*a*. The cushioning material 33 (herein also called spacer) is formed of wood, paper or plastics and has a disk shape with a larger diameter than the LWC 32.

As shown in FIG. 17, the LWC 32 has an outer diameter of about 1000 mm and an inner diameter of 500 to 600 mm. The total height of the LWC assembly 30 including the pallet 31 is about 1 to 2 m.

The method of feeding a copper pipe by the ETTS method will be explained below referring to FIG. 17.

The copper pipe 35 is fed upward from the inside of the top LWC 32 in the LWC mounted on pallet (=LWC assembly) 30. Then, in order to cut the copper pipe 35 on a pass line set horizontally about 1 m over the floor, the feeding direction is changed by a guide 34 disposed above the LWC assembly 30. Then, the copper pipe 35 is cut into a desired length by a cutter. A circular arc as the guide 34 is formed from a metal or plastic tube and has an inner diameter larger than an outer diameter of the copper pipe 35. The height from the plane on which to place the pallet 31 to the guide 34 is about 2.5 to 3.5 m. Thus, the ETTS method is defined as a method that the pipe is fed upward from the inside of the LWC placed to dispose the coil center axis perpendicular to a mount surface of the pallet 31.

The ETTS method is advantageous in removing the purchase cost of the bobbin since the bobbin 21 shown in FIG. 16 is not needed. Further, as shown in FIG. 17, since it is not needed to rotate the LWC, the uncoiler and turntable as shown in FIGS. 15A and 15B are not needed, either. Thus, the facility cost can be significantly reduced.

A method of coiling the LWC 32 will be explained below referring to FIG. 16.

As shown in FIG. 16, for example, the copper pipe 22 is wound on the inner cylinder 23 of the bobbin 21 in alignment winding from a copper pipe 22*a* at start position to the right direction. The alignment winding is a method that the copper pipe 22 is wound in a circuit around the inner cylinder 23 and then it is wound in the next circuit in close contact with the previous circuit not to have a gap therebetween.

After the first layer coil of the copper pipe 22 is wound up to the right end to have a cylinder form, the second layer coil is wound on the first layer in alignment winding along the center-axis direction of the LWC from the right end to the left end (in the reverse direction). In this case, the second layer coil is wound such that the pipe thereof is fitted into a concave part formed between adjacent pipes in the first layer, which means that the copper pipe of the second layer is arrayed in close-packed alignment to that of the first layer. Further, the third layer coil is formed on the second layer coil in alignment winding in the same manner. This is called traverse winding, where after the first-layer cylindrical coil is formed, the second-layer cylindrical coil is wound in the reverse direction along the center-axis direction of the LWC. Thereby, the LWC can be reduced in volume and, therefore, a space needed in storing and transporting can be reduced.

FIG. 18 is a schematic cross sectional view illustrating an uncoiling method in LWC. FIG. 18 indicates the uncoiling state when the LWC 20 is uncoiled by the ETTS method, where the LWC 20 is produced such that the copper pipe 22 is wound around the bobbin 21 by the winding method as shown in FIG. 16, removing the bobbin 21, disposing the LWC 20 on the cushioning material 33 as shown in FIG. 17. At first, the copper pipe 22*a* at start position on the inner layer side is fed upward. After the feeding of the first-layer is completed, the feeding of the second layer begins from a copper pipe 22*b* at lower end. Subsequently, the third layer adjoined outside of the second layer is fed from the upper end to the lower end.

However, the uncoiling method in LWC as shown in FIG. 18 has the next problems. When the LWC 20 is set as the LWC 32 in FIG. 17, the copper pipe 22*b* at lower end of the second layer is sandwiched between the cushioning material 33 (or the pallet 31) and a copper pipe 22 lying directly thereon. Therefore, it may be difficult to feed the copper pipe 22*b* due to the friction. When the friction in feeding is increased, the copper pipe 22 may be subjected to a bend or kink, resulting in product failure. Further, copper pipes 22*b* at the lower end of even-numbered layers, i.e., the second and fourth layers etc. can have the same problem.

In this regard, JP-A-2002-370869 discloses an uncoiling method to facilitate the feeding of a copper pipe at lower end in the ETTS method.

FIGS. 19 and 20 (corresponding to FIGS. 3 and 7, respectively, of JP-A-2002-370869) are schematic cross sectional views illustrating the uncoiling method to facilitate the feeding of a copper pipe at lower end.

One-side section of LWC 40 as shown in FIG. 19 is structured such that a copper pipe 41*a* at start position is located on the top, where an odd-numbered layer is n in winding number and an even-numbered layer is (n−1) in winding number. The n is a natural number of 2 or more, typically 10 or more, and the pipes are wound in alignment winding.

In the LWC 40 as shown in FIG. 19, the copper pipe 41*a* at start position on the inner layer side is fed upward. After the feeding of the first-layer is completed, the feeding of the second layer begins from a copper pipe 41*b* at lower end. In this case, since a gap exists between the copper pipe 41*b* at lower end of the second layer and the cushioning material 33 or pallet 31, the copper pipe 41*b* is less likely to be subjected to the resistance of the friction. Thus, the copper pipe 41 can be fed stably.

In contrast, FIG. 20 shows one-side section of LWC 40 that a copper pipe 41*a* at start position is located at the bottom close to the cushioning material 33. The copper pipe 41*a* at start position on the inner layer side is fed upward from the lower end to the upper end. In FIG. 20, an odd-numbered layer is n in winding number and an even-numbered layer is also n in winding number. After the feeding of the first-layer is completed, the feeding of the second layer begins from a copper pipe 41 at the upper end. In this case, since a copper pipe 41 at lower end of the second layer is not sandwiched when the copper pipe 41 turns upward, the copper pipe 41 can be fed stably as well as the case in FIG. 19.

On the other hand, when the LWC mounted on pallet 30 (=LWC assembly) is transported or stored, a fixing band etc. is frequently used to fix the LWC to prevent the collapse of the winding state of the LWC (e.g., paragraph [0005] and FIG. 13 of JP-A-2002-370869). The fixing band is generally removed before starting the feeding of the copper pipe. However, since the LWC is so heavy, the fixing band may be sandwiched between the bottom of the LWC and the pallet so that it is difficult to remove. In this regard, U.S. Pat. No. 6,502,700 B2 discloses a spacer that has a stripe groove (slot) at a portion corresponding to the fixing band to facilitate the removing of the LWC fixing band.

Meanwhile, the above is taught in paragraphs [0005], [0009] to [0012], [0014] to [0017], [0039], [0042], [0062], and [0063] and FIGS. 3, 7, 13 and 14 of JP-A-2002-370869.

However, the uncoiling method of JP-A-2002-370869 has the next problem. In the LWC wound as shown in FIG. 19, a connection from the copper pipe 41 at lower end of the first layer to the copper pipe 41*b* at lower end of the second layer is exactly formed of a continuous copper pipe, though seen as separate pipes in the cross sectional view of FIG. 19. Therefore, the copper pipe 41 must have a shift section on the circuit where it is continuously shifted outward in the radius direction the coil and upward in the vertical direction of the coil. When, of the shift section, a part being shifted outward in the radius direction of the coil is long (i.e., when the shifting upward in the vertical direction begins slow), the gap between the copper pipe 41*b* at lower end of the second layer and the cushioning material 33 or pallet 31 may substantially disappear. Namely, the copper pipe 41*b* at lower end of the second layer may be sandwiched between the cushioning material 33 or the pallet 31 and the copper pipe 41 lying directly thereon. Therefore, the feeding resistance of the copper pipe 41 may be increased so that the copper pipe 41 is subjected to a bend (kink and/or plastic buckling).

The shift section that the copper pipe is shifted to the next-layer (i.e., the outer layer) will be detailed below referring to FIGS. 21A and 21B.

FIG. 21A is a schematic cross sectional view illustrating a portion without the shift section in the LWC as shown in FIG. 19, and FIG. 21B is a schematic cross sectional view illustrating a portion with the shift section in the LWC as shown in FIG. 19. In FIGS. 21A and 21B, an arrow passing through each pipe means that the LWC is uncoiled along the arrow direction.

In the portion without the shift section as shown in FIG. 21A, of neighboring two layers, the outer layer is n−1 or n+1 in winding number when the inner layer is n in winding number. However, in the portion with the shift section 3 as shown in FIG. 21B, the outer layer is also n in winding number (i.e., the number of pipes arranged vertically in a vertical section of the coil). Furthermore, with respect to the arrangement (positional relationship) of the neighboring layers of the copper pipe 2, a stack column (herein, a stack column means a column of the stacked copper pipes in a vertical section when LWC is vertically cut along a radius of the LWC) in the portion without the shift section is arranged being fitted into a concave part formed in at least one of the neighboring stack columns (on the inner and outer sides). In contrast, a stack column (e.g., the fourth layer in FIG. 21B) in the portion with the shift section is arranged contacting a convex part formed in the neighboring stack columns. When the copper pipe 2 is fed as shown in FIG. 21B, the fourth-layer copper pipe at lower end of the shift section 3 may be sandwiched between a copper pipe lying directly thereon and the cushioning material (herein also called spacer or coil spacer) lying under the LWC. As a result, the copper pipe will be trapped by them.

Even when the spacer in U.S. Pat. No. 6,502,700 B2 is used as the cushioning material 33, it can never solve the problem during the feeding of the pipe, i.e., pipe trapping since it does not address the problem.

SUMMARY OF THE INVENTION

It is an object of the invention to provide an LWC mounted on pallet that can avoid the pipe trapping at the shift section when feeding a copper pipe from the LWC by using the ETTS method.

It is a further object of the invention to provide a package for the LWC.

As the results of analyzing the ETTS method by the inventors, it is found that the pipe trapping in the ETTS method is caused by the existence of the shift section and the arrangement thereof (i.e., the arrangement thereof at the bottom surface of the LWC, and the arrangement of a stack column in a vertical section at the shift section). Based on this finding, the inventors have completed the invention as described below.

(1) According to one aspect of the invention, a level wound coil (LWC) mounted on pallet comprises:

an LWC comprising a plurality of coil layers each of which comprises a pipe wound in alignment winding and in traverse winding, a coil of a (m+1)-th coil layer being located such that a pipe at start position thereof is fitted into a concave part formed between a pipe at a lower end and its adjacent pipe of a m-th coil layer outside of the m-th coil layer, where, when the LWC is disposed on a mount surface perpendicular to a coil center axis of the LWC, m is an odd natural number if a start position of the winding of the LWC is located at the upper end and m is an even natural number if the start position is located at the lower end; and a pallet on which the one or more LWC is mounted or on which the one or more LWC is mounted through a cushioning material, wherein the LWC comprises a shift section where the pipe is shifted from the m-th coil layer to the (m+1)-th coil layer on a bottom surface thereof when the LWC is disposed on the mount surface, the shift section comprises a k-th shift section on inner layer side and a (k+1)-th shift section on outer layer side, where k is a natural number, and a start point of the (k+1)-th shift section does not transit, relative to a start point of the k-th shift section, in a reverse direction to a winding direction of the pipe, and the pallet or the cushioning material comprises a recessed area that is formed at all or a part of a portion of the pallet or the cushioning material to face the (k+1)-th shift section not transiting in the reverse direction.

In the above invention (1), the following modifications and changes can be made.

(i) The recessed area faces the (k+1)-th shift section at least at a axis-direction non-shift section that the pipe does not transit to a direction of the coil center axis.

(ii) The recessed area is formed corresponding to only an outer layer than the middle of all layers in the LWC.

(iii) The recessed area is formed to make the pallet or the cushioning material not to be in contact with the pipe at the recessed area when the LWC is disposed on the mount surface perpendicular to the coil center axis thereof.

(iv) The recessed area comprises, at a position where to face the k-th shift section, a level difference between the recessed area and non-recessed area $G_k$[m] to satisfy formula (1):

$$G_k \geq 0.2\frac{\rho(R_k^*\phi)^4}{E\{(d-t)^2+t^2\}} \quad (1)$$

where ρ[kg/m$^3$] is a density of a material of the pipe, $R_k$*[m] is a half of an outside winding diameter of the pipe at just before a start point of the k-th shift section, ϕ[rad] is a sector angle of the recessed area viewed from the coil center axis, E[Pa] is Young's modulus of the material of the pipe, d[m] is an outer diameter of the LWC pipes and t[m] is an average wall thickness of the pipe.

(2) According to another aspect of the invention, a package for the LWC mounted on pallet as defined in (1) comprises:

a protecting and/or fixing means that covers a periphery of the LWC mounted on pallet.

Herein, "a start point of a shift section" means a start point of a shift section where a wound pipe is shifted from a m-th layer to a (m+1)-th layer, i.e., it is defined as a point from where a pipe at lower end of the m-th layer starts shifting outward in the radial direction of an LWC. Further, "an end point of a shift section" means an end point of a shift section where a wound pipe is shifted from a m-th layer to a (m+1)-th layer, i.e., it is defined as a point where a pipe at lower end of the (m+1)-th layer is fitted into a concave part formed outside between stacked pipes of the m-th layer.

Herein, "a winding direction of a pipe" means a winding direction defined when a pipe is wound around a bobbin etc. When the pipe is wound around there by rotating the bobbin, the winding direction is defined as the reverse direction to the rotation direction of the bobbin. Further, herein, "not transiting to a reverse direction to a winding direction" means a state that it transits in the forward direction to a winding direction or that it does not transit in the forward nor reverse direction.

Herein, a "shift section" is generally defined as the sum of an "axis-direction non-shift section" that a pipe is not shifted in the center-axis direction of an LWC (i.e., the axis-direction non-shift section includes (a) a part shifted only in the radial direction of an LWC and (b) a part not shifted in the radial direction nor the axis direction of the LWC), and an "axis-direction shift section" that the pipe is shifted in the center-axis direction of the LWC of the "shift section", the "axis-direction non-shift section" is likely to be sandwiched between a pipe lying directly thereon and the coil spacer (or cushioning material) so that a kink or bend may happen thereat during the feeding of the copper pipe. Meanwhile, as described earlier, the copper pipe is shifted at least outward in the coil radial direction at the start point of the "shift section".

Herein, terms for LWC are defined as follows. Viewing from the center axis of an LWC, stacked copper pipes in a concentric fashion is called "layer". From the center (=coil center axis) toward the centrifugal direction, they are numbered first layer, second layer . . . . In a layer of LWC, the number of coil circuits is called "winding number". It is also called "step number" especially when the coil center axis is disposed in the vertical direction, e.g., when the copper pipe is fed. When the coil center axis is disposed in the vertical direction, e.g., when the copper pipe is fed, a lower surface of LWC in the vertical direction to be contacted with the coil spacer (or pallet) is called "coil lower surface (lower end)" or "coil bottom", and an upper surface of LWC in the vertical direction is called "coil upper surface (upper end)". A portion shifted from m-th layer to (m+1)-th layer is called "shift section". When the coil center axis is disposed in the vertical direction, e.g., when the copper pipe is fed, the shift sections arranged at the coil lower surface are numbered k-th, (k+1)-th, . . . (from the inner side toward the outer side), where the coil pipes at the coil upper surface are not considered.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Construction of LWC

Figure 1:
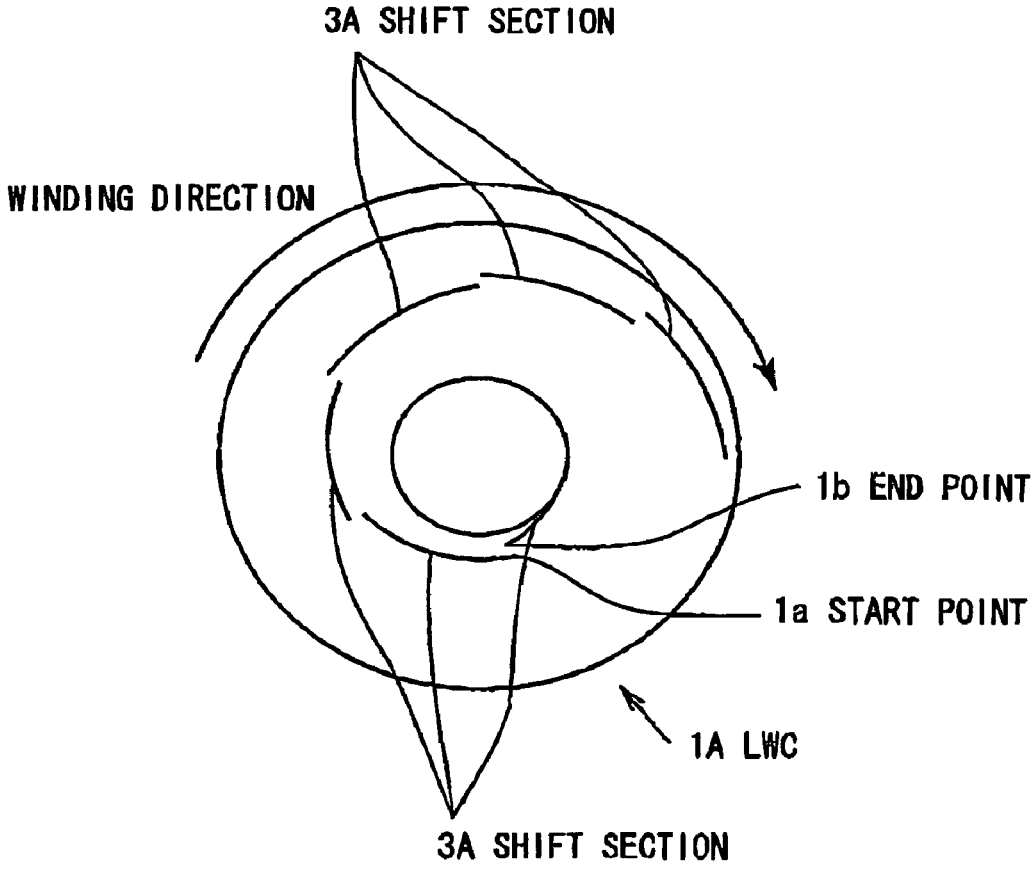
FIG. 1 is a schematic bottom view showing an LWC used for an LWC mounted on pallet in a first preferred embodiment according to the invention.
Figure 2:
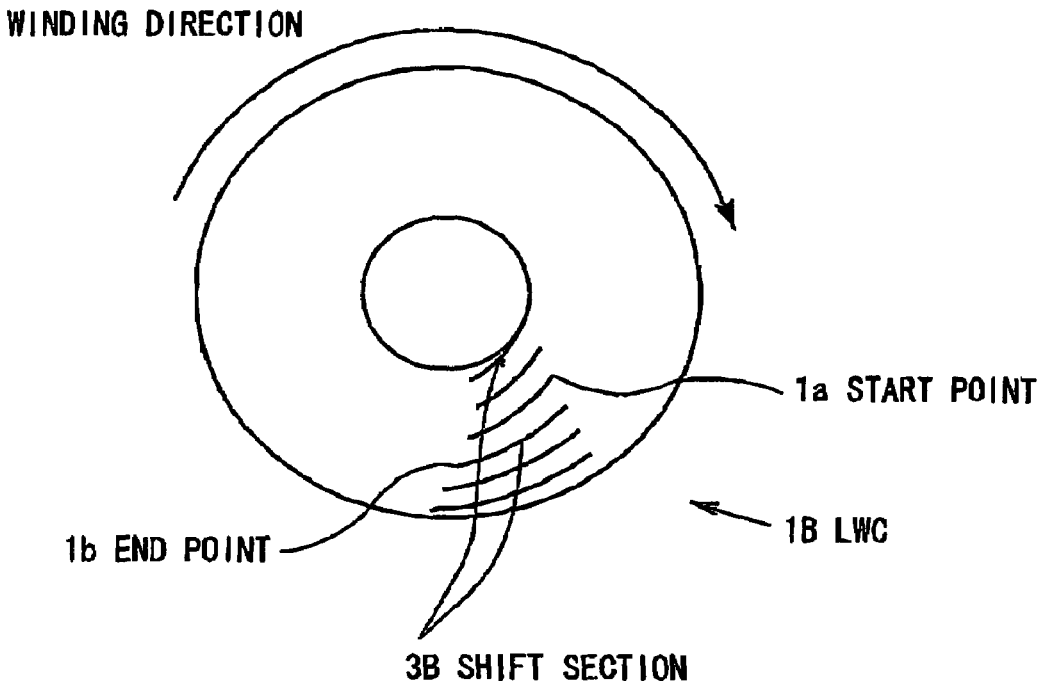
FIG. 2 is a schematic bottom view showing an LWC used for an LWC mounted on pallet in a second preferred embodiment according to the invention.
Figure 3:
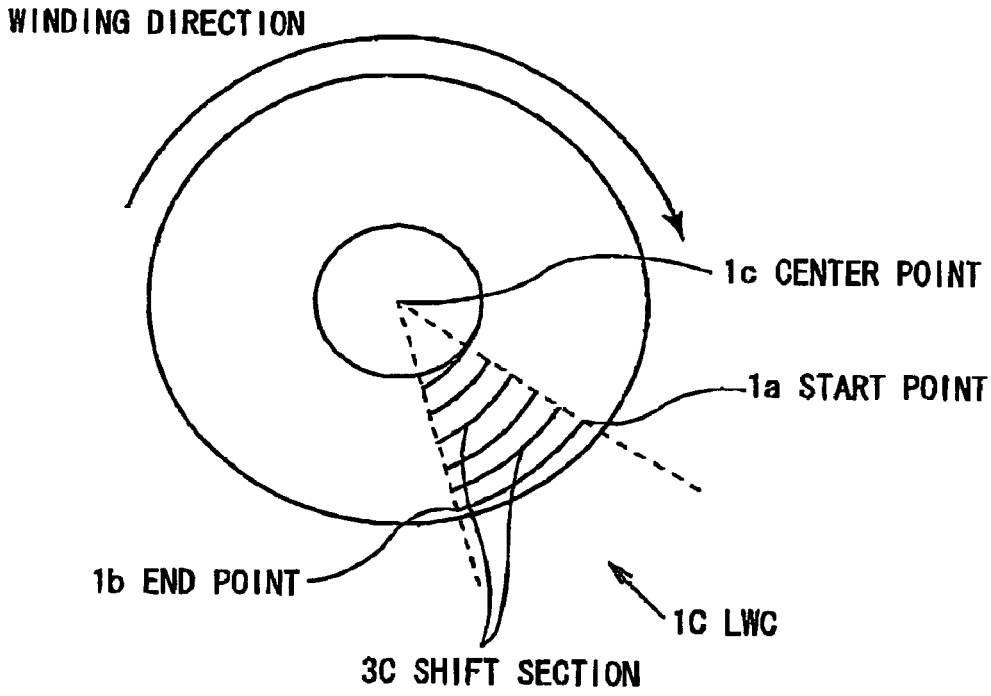
FIG. 3 is a schematic bottom view showing an LWC used for an LWC mounted on in a third preferred embodiment according to the invention.

FIGS. 1 to 3 are schematic bottom views showing LWC mounted on pallets in the first to third preferred embodiments according to the invention.

In FIGS. 1 to 3, in order to simplify the explanation, the shape of copper pipes is not illustrated and only the location of shift sections 3A to 3C in LWC's 1A to 1C is illustrated.

The LWC's of the embodiments are structured in the same manner as that of JP-A-2002-370869. However, they are different from the latter in location of the shift section on the bottom surface of the coil.

It is desired that the coil layers are as a whole odd-numbered layers when the winding start position is located at the top (with the outermost layer being odd-numbered), and that the pipe is wound up to the axis-direction non-shift section of the shift section at the lower end of the outermost layer. It is more desired that the coil layers are as a whole even-numbered layers when the winding start position is located at the top (with the outermost layer being even-numbered), and the outermost layer is 5 or less in winding number.

On the other hand, it is desired that the coil layers are as a whole even-numbered layers when the winding start position is located at the bottom (with the outermost layer being even-numbered), and that the pipe is wound up to the axis-direction non-shift section of the shift section at the lower end of the outermost layer. It is more desired that the coil layers are as a whole odd-numbered layers when the winding start position is located at the bottom (with the outermost layer being odd-numbered), and the outermost layer is 5 or less in winding number.

The LWC's in JP-A-2002-370869 are structured as any of:

(a) an LWC that (i) the coil axis direction is disposed vertically with the winding start position being at the top and the coil is uncoiled from the inside, (ii) the first layer coil is formed by winding the pipe in alignment winding, subsequently the second layer coil is formed by winding the pipe in alignment winding on the first layer coil while being fitted into a concave part formed outside between stacked pipes of the first layer coil, thereafter, in like manner, plural layer coils are formed by winding the third layer coil in alignment winding on the second layer coil, the fourth layer coil in alignment winding on the third layer coil, (iii) provided that an odd-numbered layer coil thereof has a winding number of n, an even-numbered layer coil thereof has a winding number of (n−1), and (iv) the stack direction in vertical section is reversed each other between the odd-numbered layer coil and the even-numbered layer coil;

(b) an LWC that (i) the coil axis direction is disposed vertically with the winding start position being at the bottom and the coil is uncoiled from the inside, (ii) the first layer coil is formed by winding the pipe in alignment winding, subsequently the second layer coil is formed by winding the pipe in alignment winding on the first layer coil while being disposed into a concave part (or a part adjacent to there) formed outside between stacked pipes of the first layer coil, thereafter, in like manner, plural layer coils are formed by winding the third layer coil in alignment winding on the second layer coil, the fourth layer coil in alignment winding on the third layer coil, (iii) provided that an odd-numbered layer coil thereof has a winding number of n, an even-numbered layer coil thereof has a winding number of (n+1), and (iv) the stack direction in vertical section is reversed each other between the odd-numbered layer coil and the even-numbered layer coil; and (c) an LWC that (i) the coil axis direction is disposed vertically and the coil is uncoiled from the inside, (ii) the first layer coil is formed by winding the pipe in alignment winding, subsequently the second layer coil is formed by winding the pipe in alignment winding on the first layer coil while being disposed into a concave part (or outside thereof) formed outside between stacked pipes of the first layer coil such that the pipe at start position of the second layer is fitted into a concave part formed between the pipe at lower/upper end and its adjacent pipe of the first layer coil, thereafter, in like manner, plural layer coils are formed by winding the third layer coil in alignment winding on the second layer coil, the fourth layer coil in alignment winding on the third layer coil, (iii) provided that an odd-numbered layer coil thereof has a winding number of n, an even-numbered layer coil thereof has a winding number of n, and (iv) the stack direction in vertical section is reversed each other between the odd-numbered layer coil and the even-numbered layer coil.

FIGS. 1 and 2 (corresponding to the first and second embodiments, respectively) are schematic bottom views showing LWC examples used for the LWC mounted on pallet, where a start point 1*a* of a (k+1)-th shift section (on outer-layer side) transits, relative to a start point 1*a* of a k-th shift section (on inner-layer side), in a forward direction to the winding direction (i.e., clockwise) of the copper pipe. In these examples, the shift section transits in the forward direction (i.e., clockwise) to the winding direction (i.e., clockwise) of the copper pipe. Naturally, the shift section may transit in the forward direction (i.e., counterclockwise) to the winding direction (i.e., counterclockwise) of the copper pipe.

FIG. 3 (=the third preferred embodiment according to the invention) is a schematic bottom view showing LWC example used for the LWC mounted on pallet, where the start point 1*a* of the (k+1)-th shift section (on outer-layer side) does not transit, relative to the start point 1*a* of the k-th shift section (on inner-layer side), in a forward or reverse direction to the winding direction of the copper pipe.

As shown in FIG. 3, the LWC 1C is constructed such that the k-th shift section 3C (on inner-layer side) and the (k+1)-th shift section 3C (on outer-layer side) transit lying on a same radius on the bottom surface of the LWC 1C. Further, all the shift sections 3C are within a sector region that is formed connecting between a center point 1*c* on the bottom surface of the LWC 1C and the start point 1*a* and end point 1*b* of the outermost shift section 3C.

The LWC used for the LWC mounted on pallet of the invention may be constructed by a combination of the arrangement as shown in FIG. 1 or 2 (=the first or second embodiment) and the arrangement as shown in FIG. 3 (=the third embodiment.) Namely, it may include both a shift section to transit in a forward direction to the winding direction of the copper pipe and a shift section not to transit in a forward or reverse direction to the winding direction of the copper pipe. Further, in any one of the above embodiments, a part of the shift section may transit in a reverse direction to the winding direction of the other part thereof.

Method of Manufacturing the LWC According to the Invention

LWC's according to the invention can be manufactured by the conventional method. For example, the method as disclosed in JP-A-2002-370869 (e.g., paragraph [0039]) is available. However, the invention's method is different from the conventional method in that it is conducted to adjust (or control) the location of a shift section formed at the lower end of LWC by changing the shift start position in shifting from an m-th layer (on inner-layer side) to an (m+1)-th layer (on outer-layer side).

The method of adjusting (or controlling) the location is not specifically limited. For example, in winding the copper pipe around the bobbin, the shift section can be adjusted by delaying the timing to shift from the m-th layer (on inner-layer side) to the (m+1)-th layer (on outer-layer side) at a return portion of the traverse winding to form the lower end of LWC, in order that the shift section transits in a forward direction to the winding direction.

The location of the shift section as shown in FIGS. 1 and 2 can be obtained by winding such that a start point of a (k+1)-th shift section (on outer-layer side) is delayed forward in the winding direction from a vertical section (located on the same side when viewing from the coil center axis) including the coil center axis where a start point of a k-th shift section (on inner-layer side) is located.

The location of the shift section as shown in FIG. 3 can be obtained by winding such that the start point of the k-th shift section (on inner-layer side) and the (k+1)-th shift section (on outer-layer side) is located at the same vertical section (located on the same side when viewing from the coil center axis) including the coil center axis, and the end point of the k-th shift section (on inner-layer side) and the (k+1)-th shift section (on outer-layer side) is located at the same vertical section (located on the same side when viewing from the coil center axis, and different from that including the start point) including the coil center axis.

Process of Forming the Shift Section

The process of forming the shift section will be described below.

FIGS. 4A to 4E are schematic perspective views showing a process of forming a shift section in an LWC.

Figure 4A:
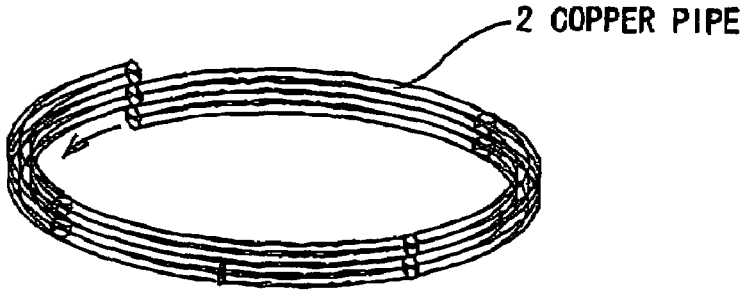
FIGS. 4A to 4E are schematic perspective views showing a process of forming a shift section in an LWC.
Figure 4B:
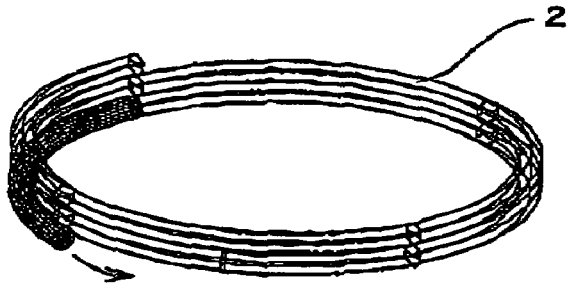
Figure 4C:
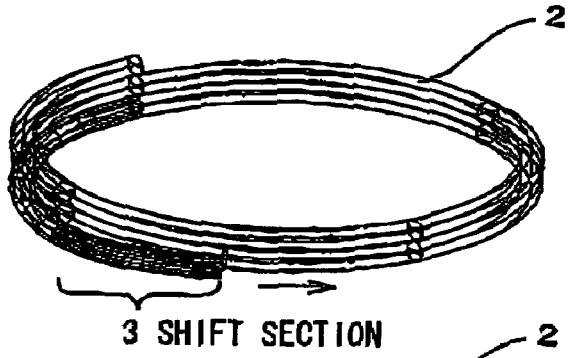
Figure 4D:
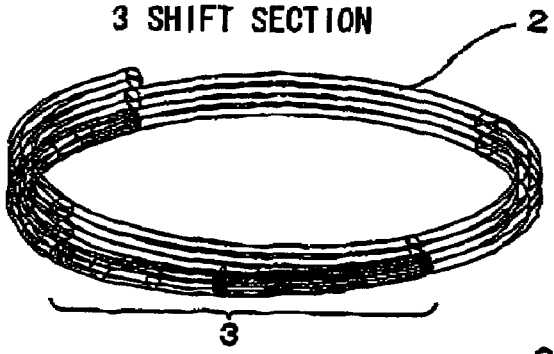
Figure 4E:
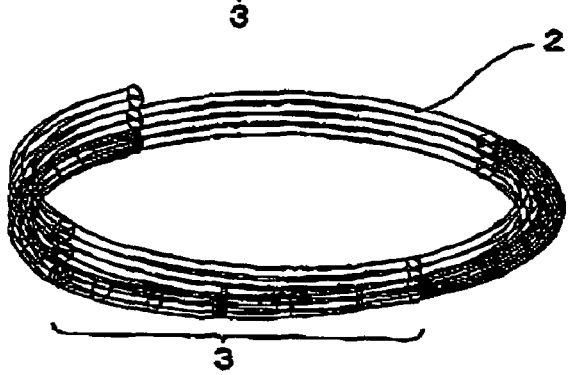

At the bottom side of each of FIGS. 4A to 4E, a copper pipe at lower end in a certain layer in the LWC is shown. When the copper pipe is wound up to the lower end (FIGS. 4A and 4B), a shift section 3 appears in shifting to the next layer (the outer layer) (FIG. 4C), and then the copper pipe is shifted to the next layer while further forming the shift section 3 (FIGS. 4D and 4E). In FIGS. 4A to 4E, for simplification in explanation, the pipe (coil) is shown helical-wound (=in spiral winding).

Figure 5:
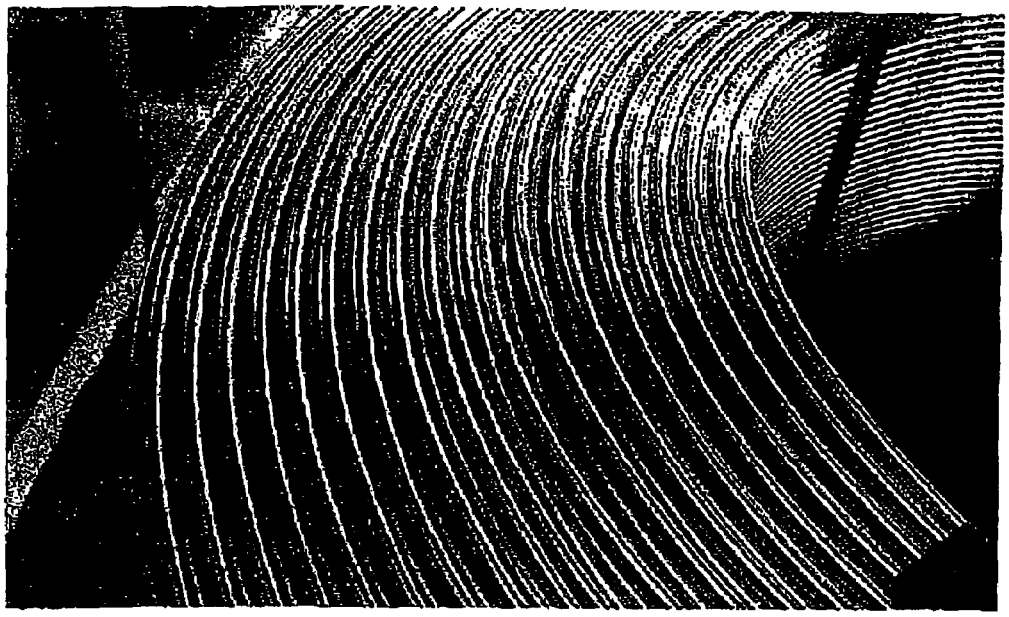
FIG. 5 is a photograph showing a part of a shift section on the bottom surface of an LWC.

FIG. 5 is a photograph showing a part of a shift section on the bottom surface of an LWC. It is found in FIG. 5 that the pipe winding configuration of about the eighth to ninth layers from the innermost layer is different from that of the other layers, where a wound part in the former corresponds to a part of the shift section.

Relationship Between Pipe Winding Method and Configuration of Shift Section

Referring to FIGS. 6 to 11, the relationship between the pipe winding method and the configuration of shift section will be explained below. Although a start point of a shift section is shown in FIGS. 6 to 11, a real start point is located at just after the start point as shown.

Figure 6:
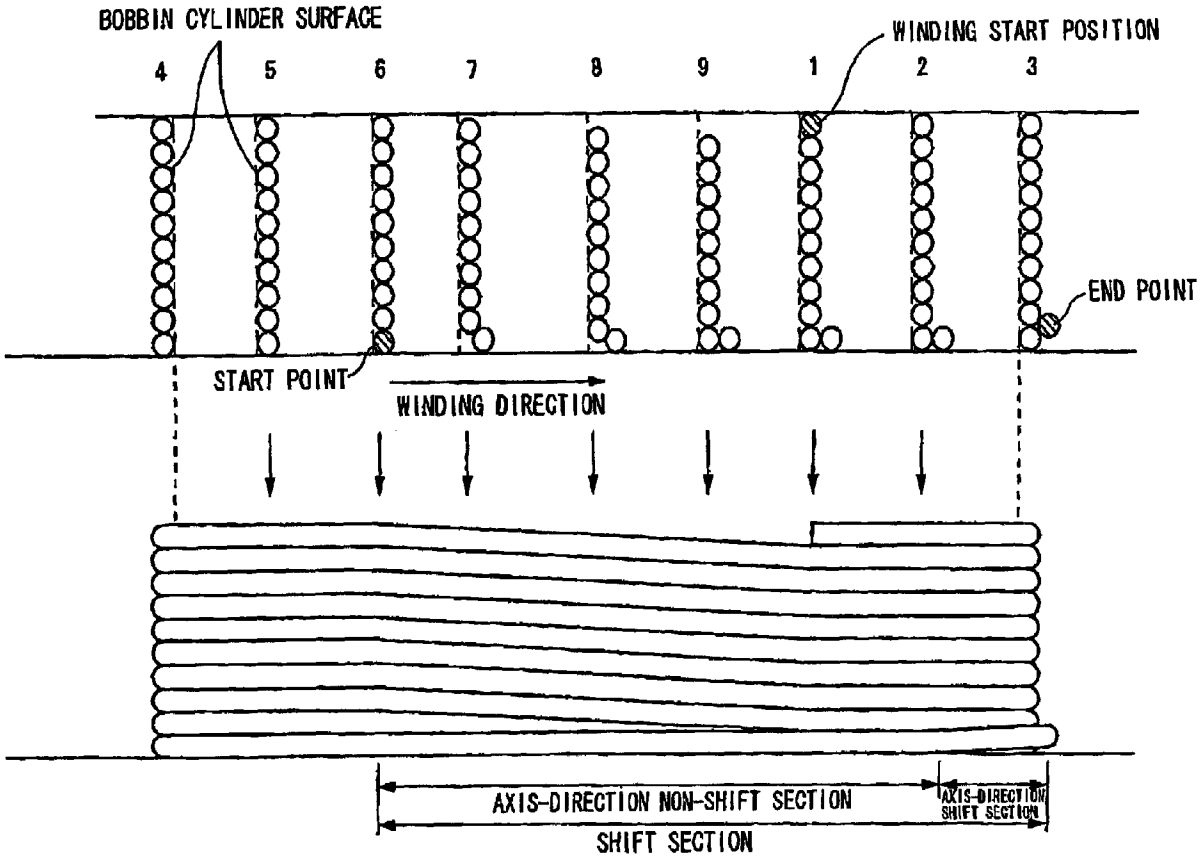
FIG. 6 is a schematic side view of LWC (below) and a schematic vertical cross sectional view of LWC (above) at each position (Nos. 1-9) as indicated by a downward arrow showing a shift section from the first layer to the second layer in a winding method, where a start point of a (k+1)-th shift section (on outer-layer side) transits, relative to a start point of a k-th shift section (on inner-layer side), in a forward direction to the winding direction of a copper pipe.
Figure 7:
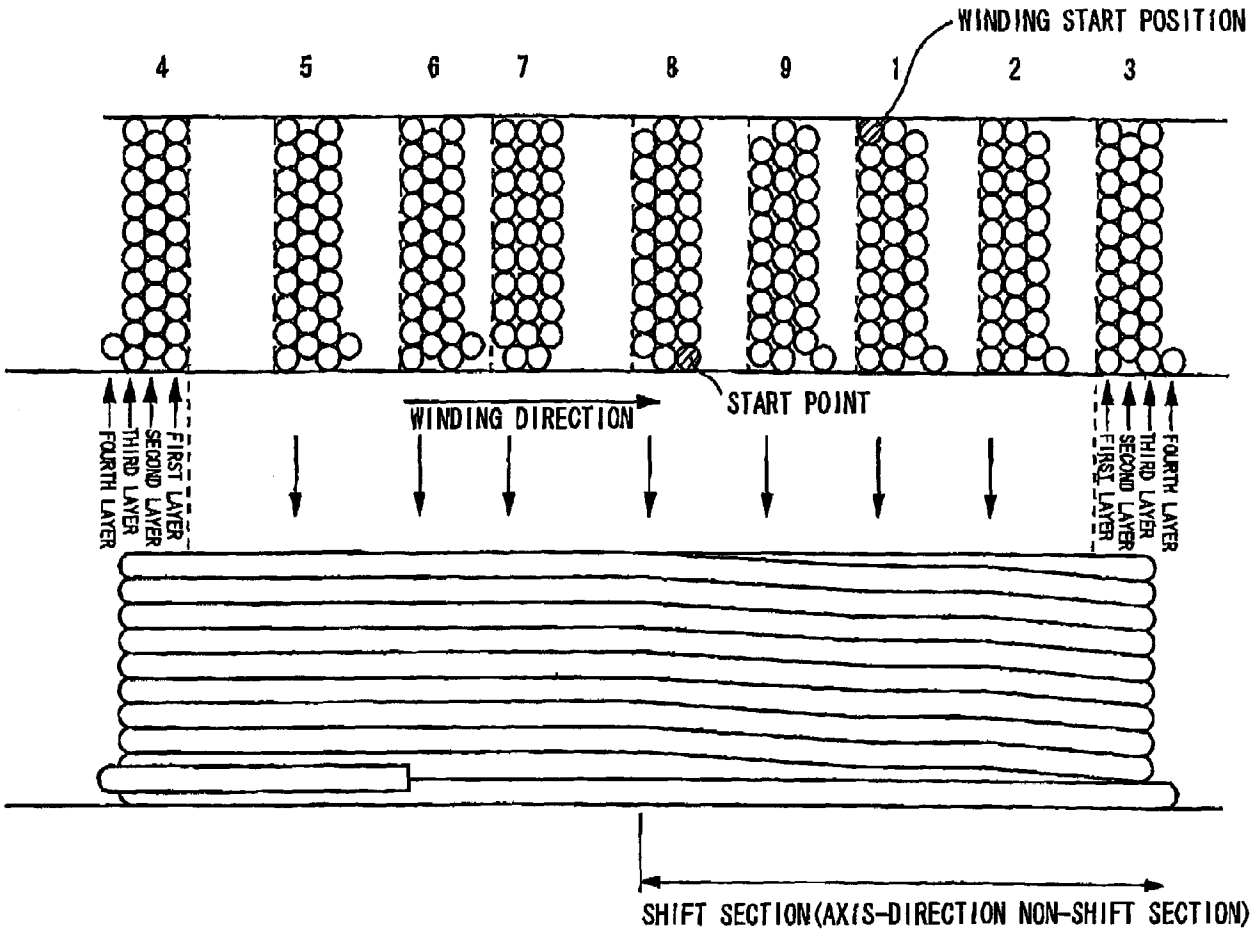
FIG. 7 is a schematic side view of LWC (below) and a schematic vertical cross sectional view of LWC (above) at each position (Nos. 1-9) as indicated by a downward arrow showing a shift section from the third layer to the fourth layer in the winding method in FIG. 6.

FIGS. 6 and 7 show a winding method, where a start point of a (k+1)-th shift section (on outer-layer side) transits, relative to a start point of a k-th shift section (on inner-layer side), in a forward direction to the winding direction of a copper pipe.

FIG. 6 is a schematic side view of LWC (below) and a schematic vertical cross sectional view of LWC (above) at each position (Nos. 1-9) as indicated by a downward arrow showing a shift section (and a transition region before and/or after there) from the first layer to the second layer. Meanwhile, the start point and end point of a shift section are also referred to as start position and end position with respect to FIGS. 6 to 11.

FIG. 7 is a schematic side view of LWC (below) and a schematic vertical cross sectional view of LWC (above) at each position (Nos. 1-9) as indicated by a downward arrow showing a shift section (and a transition region before and/or after there) from the third layer to the fourth layer.

It is found that, as compared to the position (i.e., from the start position 6 to the end position 3) of the shift section as shown in FIG. 6, the position (i.e., from the start position 8 to an end position located behind) of the shift section as shown in FIG. 7 is delayed more than one circuit. By the winding method, the LWC as shown in FIGS. 1 and 2 can be formed. This method is easy in winding when the LWC for the ETTS is produced. However, it is found in FIGS. 6 and 7 that its axis-direction non-shift section (a section being sandwiched between a copper pipe and a mount surface) is so long that the pipe is likely to be trapped. Therefore, the LWC needs to be mounted on the spacer (=cushioning material) as described later.

Figure 8:
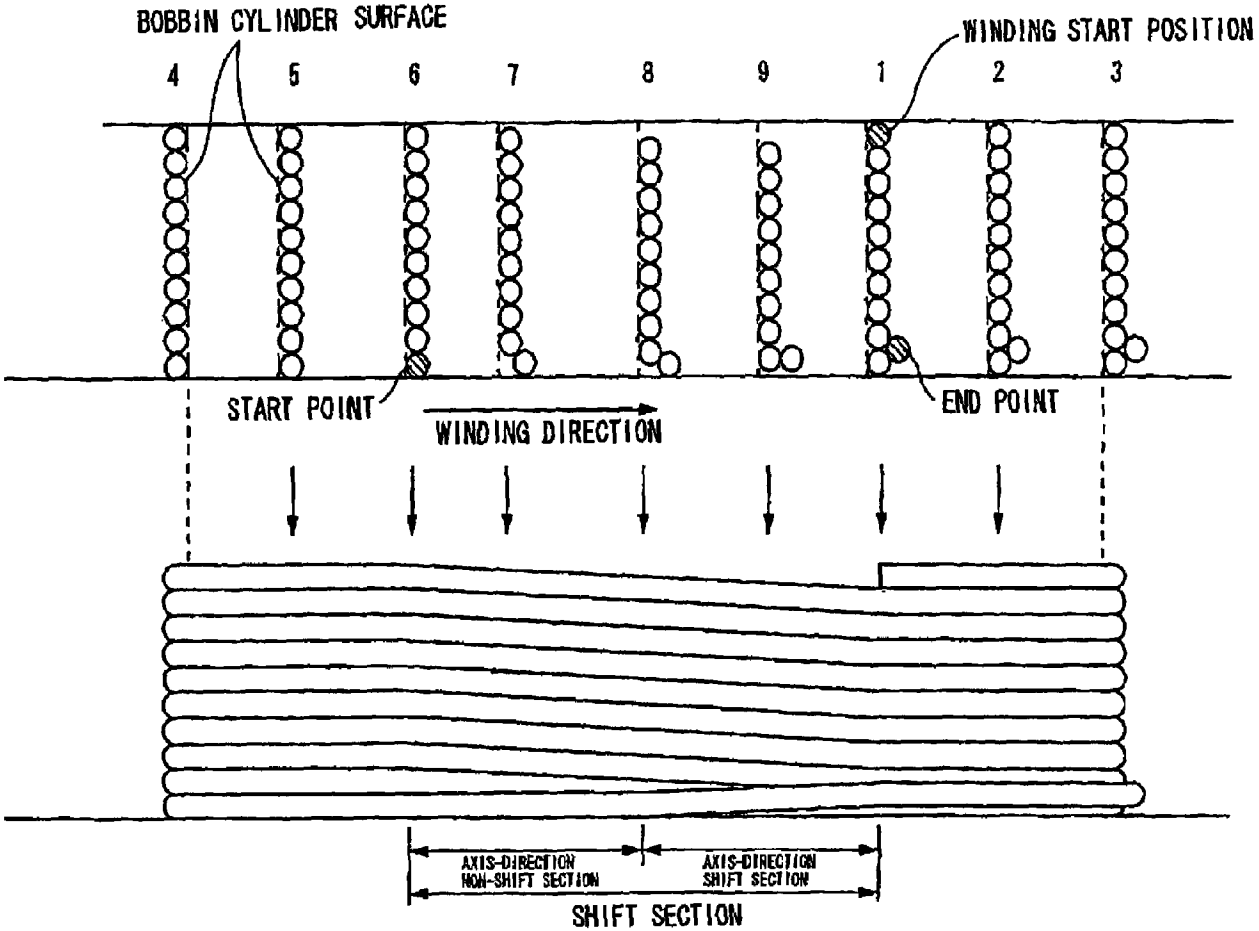
FIG. 8 is a schematic side view of LWC (below) and a schematic vertical cross sectional view of LWC (above) at each position (Nos. 1-9) as indicated by a downward arrow showing a shift section from the first layer to the second layer in another winding method, where a start point of a (k+1)-th shift section (on outer-layer side) does not transit, relative to a start point of a k-th shift section (on inner-layer side), in a forward or reverse direction to the winding direction of a copper pipe.
Figure 9:
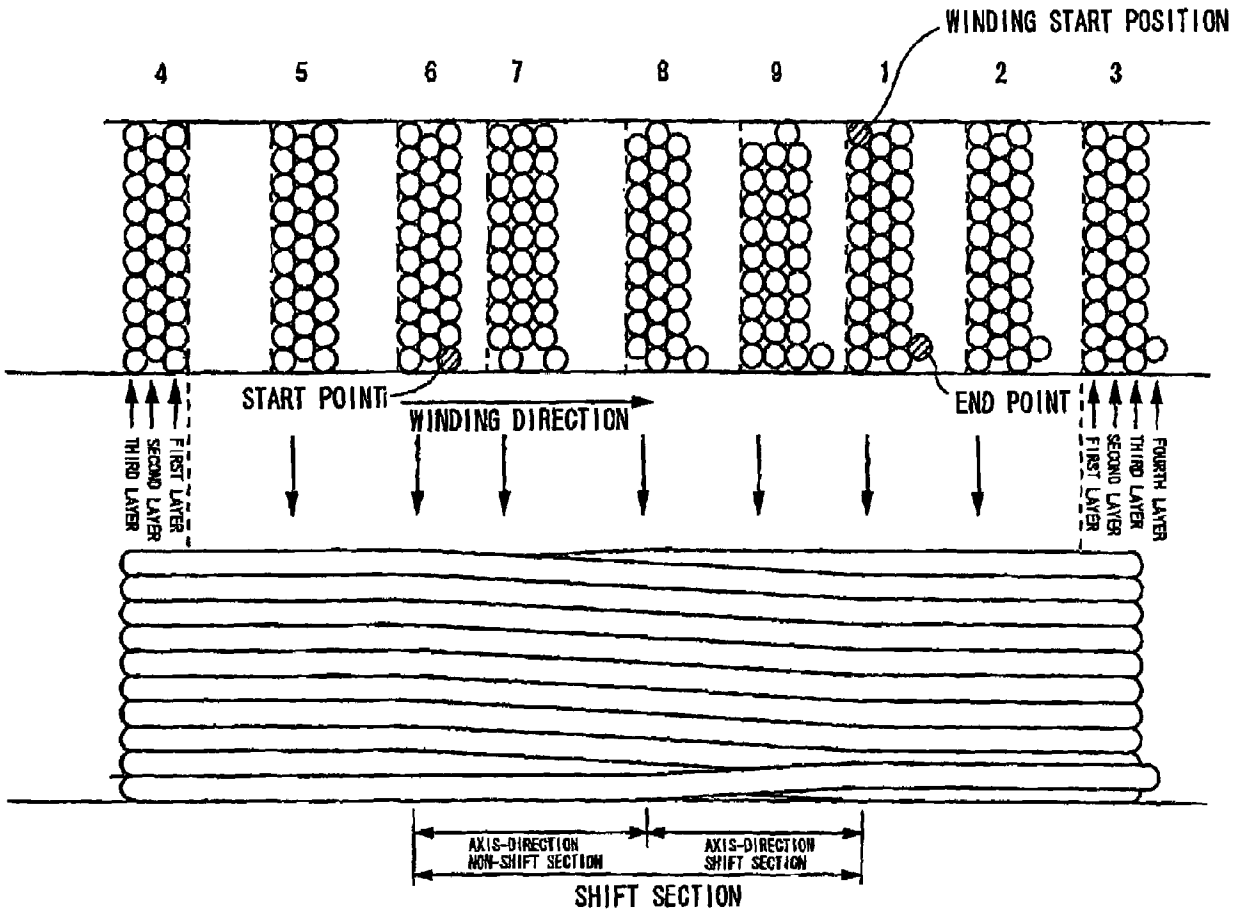
FIG. 9 is a schematic side view of LWC (below) and a schematic vertical cross sectional view of LWC (above) at each position (Nos. 1-9) as indicated by a downward arrow showing a shift section from the third layer to the fourth layer in the winding method in FIG. 8.

FIGS. 8 and 9 show a winding method, where a start point of a (k+1)-th shift section (on outer-layer side) does not transit, relative to a start point of a k-th shift section (on inner-layer side), in a forward or reverse direction to the winding direction of a copper pipe.

FIG. 8 is a schematic side view of LWC (below) and a schematic vertical cross sectional view of LWC (above) at each position (Nos. 1-9) as indicated by a downward arrow showing a shift section (and a transition region before and/or after there) from the first layer to the second layer.

FIG. 9 is a schematic side view of LWC (below) and a schematic vertical cross sectional view of LWC (above) at each position (Nos. 1-9) as indicated by a downward arrow showing a shift section (and a transition region before and/or after there) from the third layer to the fourth layer.

It is found that the position (i.e., from the start position 6 to the end position 1) of the shift section as shown in FIG. 8 is located at substantially the same position as the position (i.e., from the start position 6 to the end position 1) of the shift section as shown in FIG. 9. The LWC as shown in FIG. 3 can be formed by this method. Further, it is found in FIGS. 8 and 9 that its axis-direction non-shift section (a section being sandwiched between a copper pipe and a mount surface) of the shift section is shorter than that in FIGS. 6 and 7 so that the pipe is less likely to be trapped. However, it is desired that the LWC is mounted on the spacer (=cushioning material) as described later.

Figure 10:
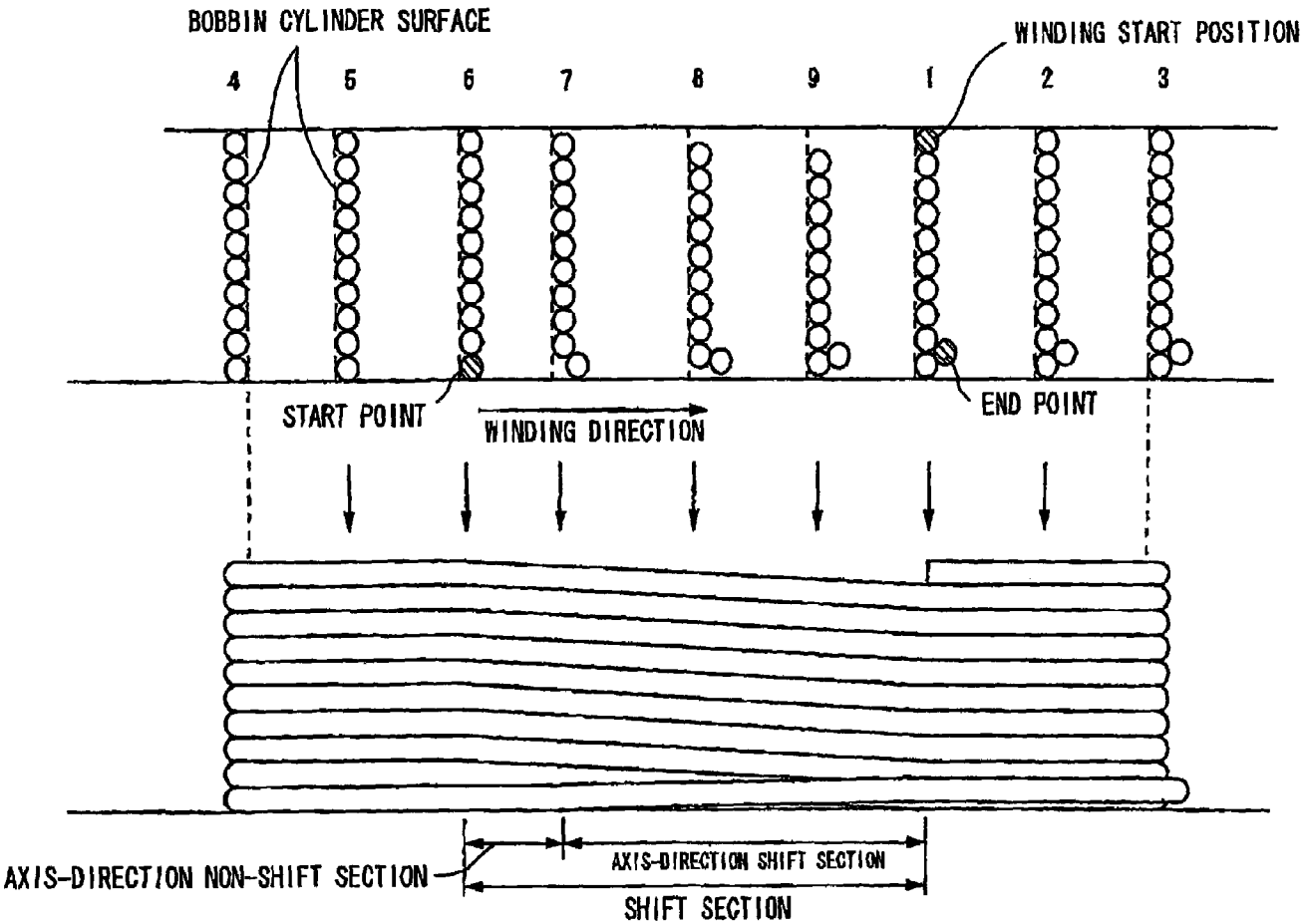
FIG. 10 is a schematic side view of LWC (below) and a schematic vertical cross sectional view of LWC (above) at each position (Nos. 1-9) as indicated by a downward arrow showing a shift section from the first layer to the second layer in another winding method, where a start point of a (k+1)-th shift section (on outer-layer side) transits, relative to a start point of a k-th shift section (on inner-layer side), in a reverse direction to the winding direction of a copper pipe.
Figure 11:
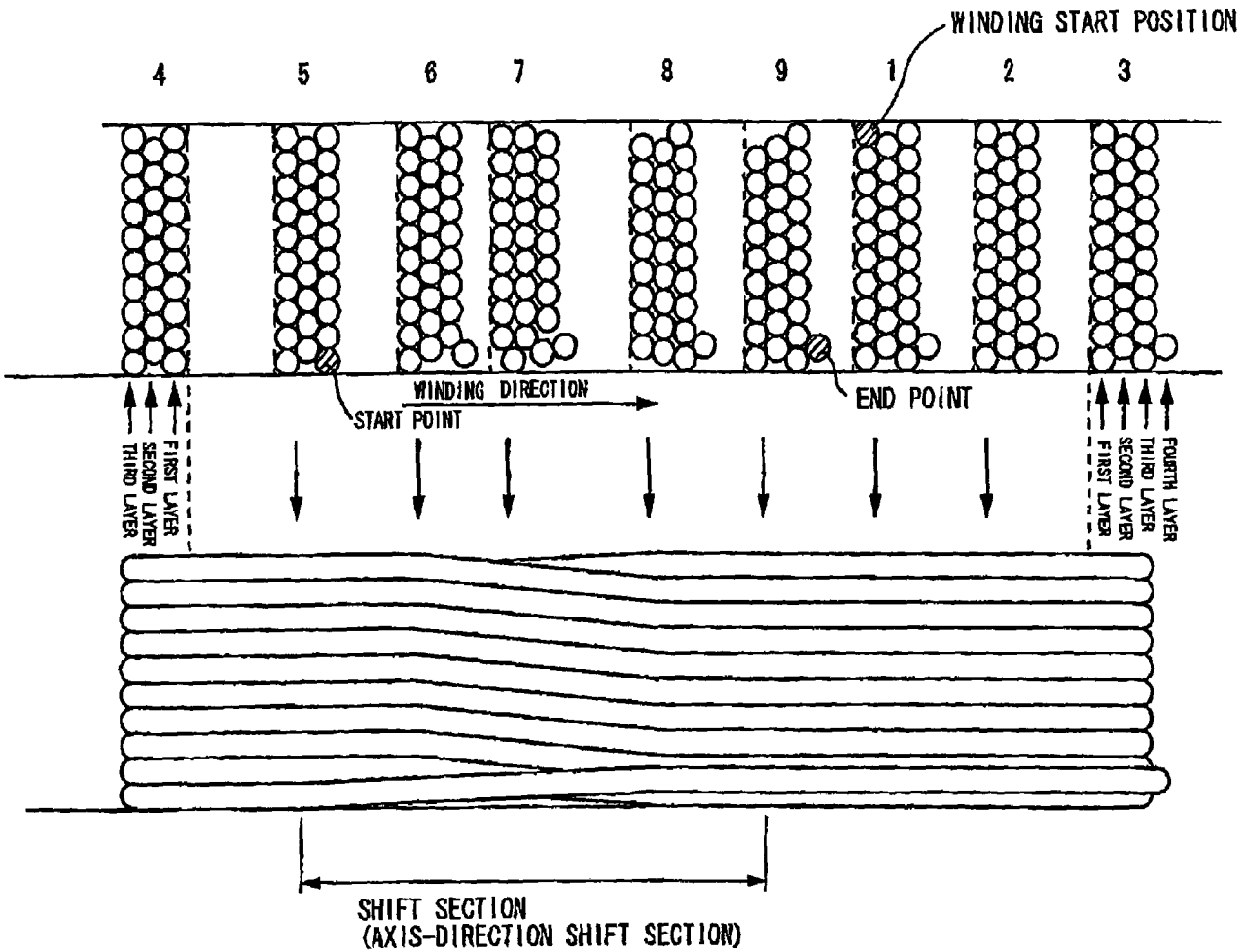
FIG. 11 is a schematic side view of LWC (below) and a schematic vertical cross sectional view of LWC (above) at each position (Nos. 1-9) as indicated by a downward arrow showing a shift section from the third layer to the fourth layer in the winding method in FIG. 10.

FIGS. 10 and 11 show a winding method, where a start point of a (k+1)-th shift section (on outer-layer side) transits, relative to a start point of a k-th shift section (on inner-layer side), in a reverse direction to the winding direction of a copper pipe.

FIG. 10 is a schematic side view of LWC (below) and a schematic vertical cross sectional view of LWC (above) at each position (Nos. 1-9) as indicated by a downward arrow showing a shift section (and a transition region before and/or after there) from the first layer to the second layer.

FIG. 11 is a schematic side view of LWC (below) and a schematic vertical cross sectional view of LWC (above) at each position (Nos. 1-9) as indicated by a downward arrow showing a shift section (and a transition region before and/or after there) from the third layer to the fourth layer.

It is found that, as compared to the position (i.e., from the start position 6 to the end position 1) of the shift section as shown in FIG. 10, the position (i.e., from the start position 5 to the end position 9) of the shift section as shown in FIG. 11 is advanced one circuit. Further, it is found in FIGS. 10 and 11 that its axis-direction non-shift section (a section being sandwiched between a copper pipe and a mount surface) is so short (nearly disappeared) that the pipe is less likely to be trapped.

Composition of LWC Mounted on Pallet

The LWC mounted on pallet (=LWC assembly) in the preferred embodiment of the invention is used in feeding a copper pipe by the ETTS method. It has the same appearance as the LWC mounted on pallets (=LWC assemblies) in JP-A-2002-370869 and U.S. Pat. No. 6,502,700 B2, but different from them mainly in the control of the arrangement of the shift section (or the winding method of LWC's copper pipe) and in the structure of the cushioning material 33 (=spacer).

The spacer used in the LWC mounted on pallet of the embodiment is provided with a recessed area that is formed at all parts or a part thereof to face at least one (preferably, all) of or more shift sections not transiting in a reverse direction to the winding direction of the pipe. Especially, when the recessed area is formed at a part of the shift section, it is formed at a part to face an axis-direction non-shift section (being not shifted in the coil center axis direction) of the shift section being not transiting in the reverse direction. It is desired that, by the formation of the recessed area, the pipe of the LWC can not be in contact with the pallet or spacer at the recessed area when mounting the LWC to dispose the coil center axis perpendicular to the mount surface.

Figure 12A:
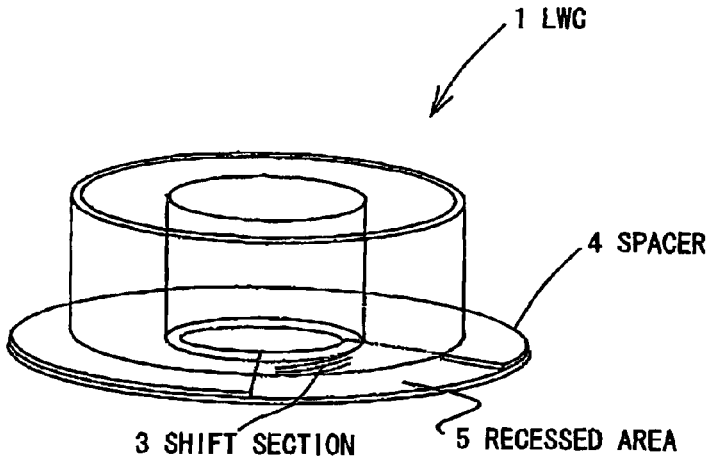
FIG. 12A is a schematic perspective view showing an LWC mounted on pallet in a preferred embodiment of the invention.

FIG. 12A is a schematic perspective view showing an LWC mounted on pallet in a preferred embodiment of the invention. The spacer 4 is provided with the recessed area 5 formed at a part (especially, at a contact part in case of not forming the recessed area) to face the shift section 3 at the bottom of LWC 1. By composing it thus, the pipe trapping phenomenon at the shift section 3 can be prevented when feeding the copper pipe from the LWC 1.

Conditions for Determining a Level Difference of the Recessed Area

Conditions for determining a level difference of the recessed area 5 can be derived as described below.

It is assumed that the copper pipe is kept floated like a transverse beam over the recessed area 5 of the spacer 4. Thus, a level difference to keep the copper pipe almost not in contact with the recessed area 5 needs to be equal to or more than a maximum deflection of a beam with both ends fixed. A copper pipe at lower end is subjected to a load of copper pipes included in nearly one layer (i.e., a copper pipe column at a vertical section cut along a radius from the coil center axis) stacked on the copper pipe. However, since it can be assumed that each copper pipe of the nearly one layer has the same rigidity and deflection, only the own weight of the copper pipe at lower end has to be considered to calculate the amount of deflection. Therefore, the maximum deflection is obtained by $(P \times L^3)/(384 \times E \times I)$, where E[Pa] is a Young's modulus of the pipe material after the tempering of LWC, I[$m^4$] is a moment of inertia of area of the copper pipe, P[kg] is an own weight of copper pipes floated, and L[m] is a length of the copper pipes floated.

Figure 12B:
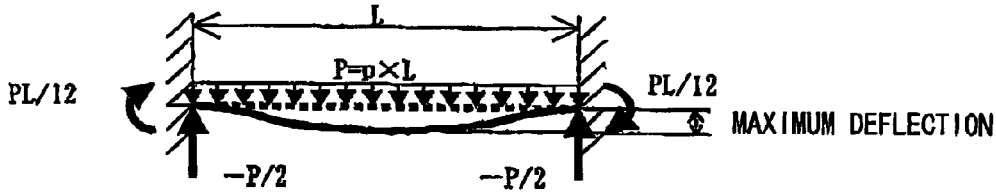
FIG. 12B is a schematic illustration showing a model used in deriving a maximum deflection.

FIG. 12B is a schematic illustration showing a model used in deriving the maximum deflection. In FIG. 12B, ρ[N/m] is a distributed load in a unit length. In consideration of the above maximum deflection, a level difference between the recessed area and non-recessed area $G_k$[m] at a position where to face a k-th shift section is desirably to meet the relationship of formula (1):

$$G_k \geq 0.2\frac{\rho(R_k^*\phi)^4}{E\{(d-t)^2+t^2\}} \quad (1)$$

where ρ[kg/m$^3$] is a density of the pipe material, $R_k$*[m] is a half of an outside winding diameter of the pipe at just before a start point of the k-th shift section, ϕ[rad] is a sector angle of the recessed area (in a case of a continuous recessed area, each recessed area corresponding to a position where to face each shift section) viewed from the coil center axis, d[m] is an outer diameter of the LWC pipe, and t[m] is an average wall thickness of the pipe, and 0.2, the coefficient in formula (1) is obtained by rounding the calculated value, (9.8×8)/384=0.204 . . . to one decimal place.

$R_k$* is defined as described above to derive an average curvature radius since the pipe is shifted at least to the outer-layer side in the coil radius direction at the shift section (i.e., the curvature radius of the pipe being varied there).

It is desired that the sector angle ϕ of the recessed area is set to include the axis-direction non-shift section of the k-th shift section.

Since the shift section is likely to be longer on the outer-layer side of LWC, the shift section on the outer-layer side is trapped more often than that on the inner-layer side when feeding the copper pipe by the ETTS method. Therefore, it is more desired that, in order not to be trapped even at the shift section of the outermost-layer, $R_k$* is replaced by a curvature radius $R_{out}$[m] at the pipe of the outermost layer to calculate the level difference conditions.

Further, in consideration of the production precision of LWC (e.g., unevenness at the bottom of LWC, fluctuation in pipe tempered by annealing), the thickness (e.g., about 2 to 10 mm) of a spacer material (e.g., paper cardboard or plastic cardboard) used typically, and the processability and productivity of the spacer, it is also desired that $R_k$* is replaced by $D_k$[m], an outside winding diameter of the pipe at just before a start point of the k-th shift section to calculate the level difference conditions.

The recessed area may be formed penetrating to the bottom of the spacer instead of having a level difference (to form a concave part). The width (length in the coil radius direction) of the recessed area is desirably equal to or more than the outer diameter of the pipe. In consideration of the margin of positioning accuracy, it is more desirably two times (=2d) or more of the outer diameter of the pipe.

When the shift section is concentrated at a part of the whole surface as shown in FIG. 12A, the level difference is formed concentrated at the part by forming the recessed area on the spacer. Due to this, during the transportation of the LWC mounted on pallet, the coil may be shifted from the spacer or the LWC may be tilted at the level difference. Thus, considering the shifting or tilting of LWC during the transportation due to the recessed area, it is desired that the shift section is located well-balanced over the surface in order not to concentrate at one part. Alternatively, in the case of concentrating partially, the recessed area may be formed, as described later, only on the outer-layer side where the pipe trapping phenomenon is more likely to happen.

EXAMPLES OF THE SPACER

Figure 13:
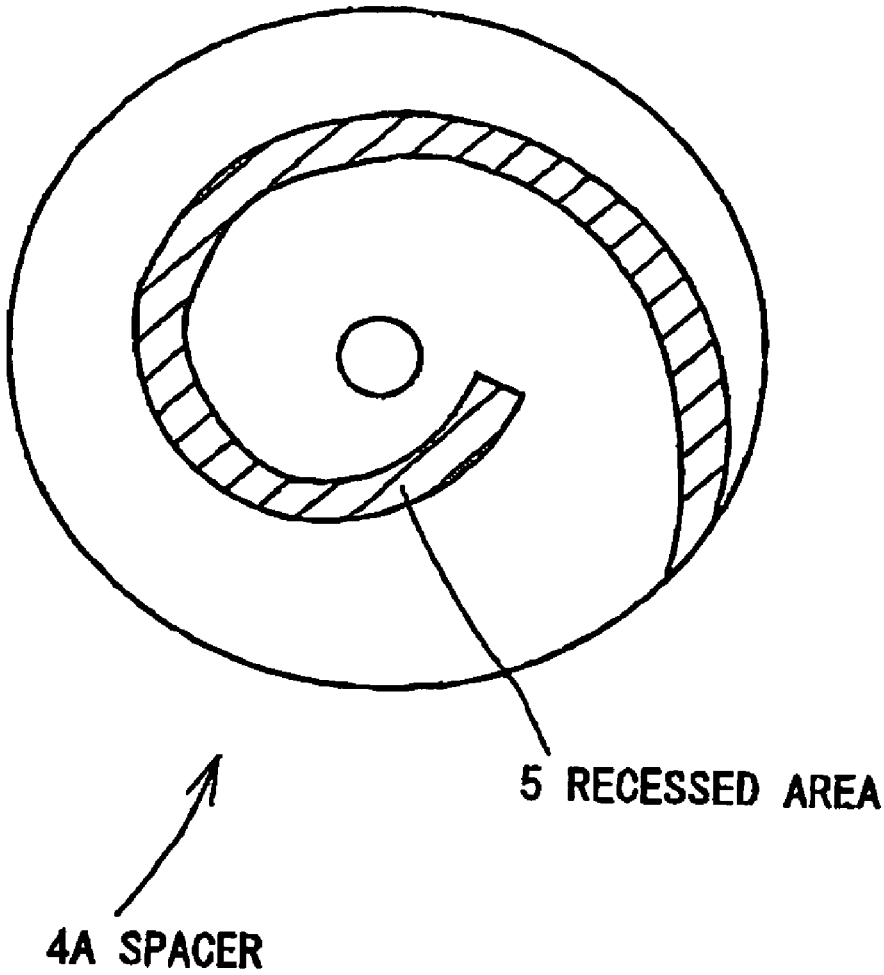
FIG. 13 is a top view showing a spacer used for the LWC mounted on pallet in FIG. 1.

FIG. 13 is a top view showing a spacer used for the LWC mounted on pallet in FIG. 1. The spacer 4 has a recessed area 5A at a portion where to face all parts including the axis-direction non-shift section of the shift section 3A not transiting in the reverse direction. Thereby, the pipe trapping phenomenon at the shift section can be prevented.

Figure 14A:
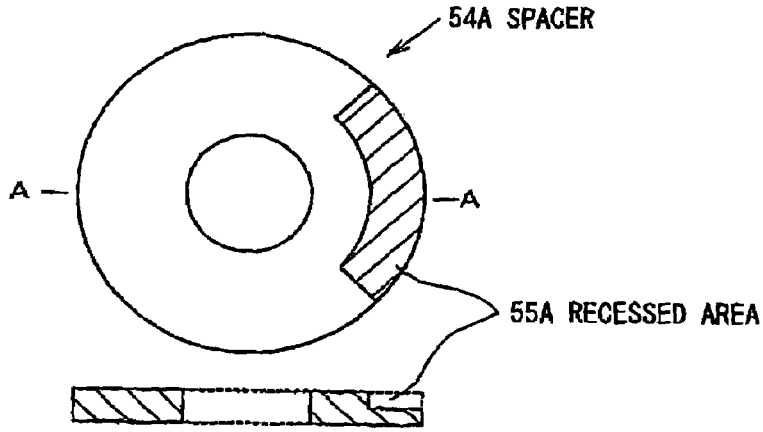
FIG. 14A is a top view (above) showing a spacer in a preferred embodiment of the invention and a cross sectional view (below) cut along a line A-A thereof.

FIG. 14A is a top view (above) showing a spacer in the preferred embodiment of the invention and a cross sectional view (below) cut along a line A-A thereof.

As shown in FIG. 14A, the spacer 54A is provided with a recessed area 55A only at a portion corresponding to the shift section on the outer-layer side. As described earlier, the outer-layer side of the coil is more likely to be trapped than the inner-layer side since the shift section may be longer. Therefore, the spacer 54A has the recessed area 55A only on the outer-layer side (i.e., outer than the middle of all layers, especially, a layer corresponding to the third to sixth shift section from the outermost layer).

Figure 14B:
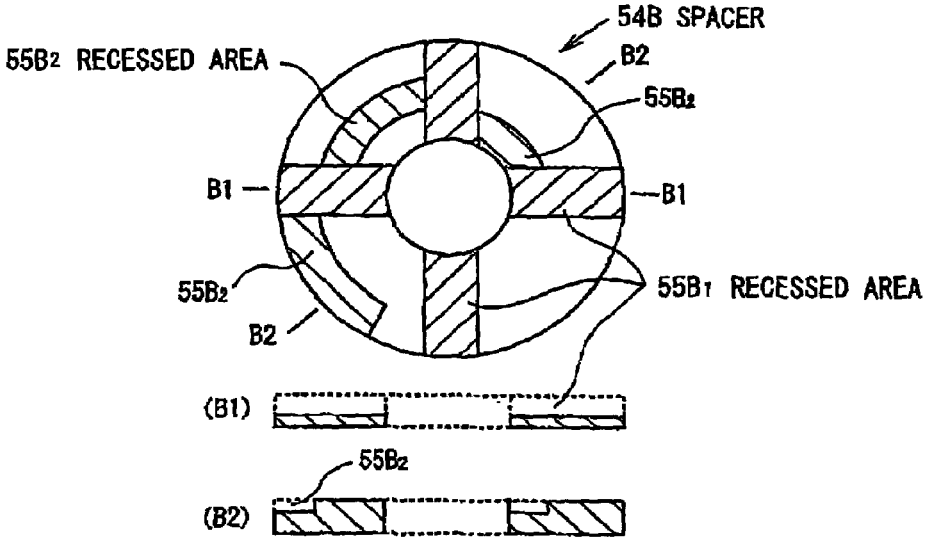
FIG. 14B is a top view (above) showing a spacer in a preferred embodiment of the invention and cross sectional views (below) cut along a line B1-B1 or a line B2-B2 thereof.
Figure 15A:
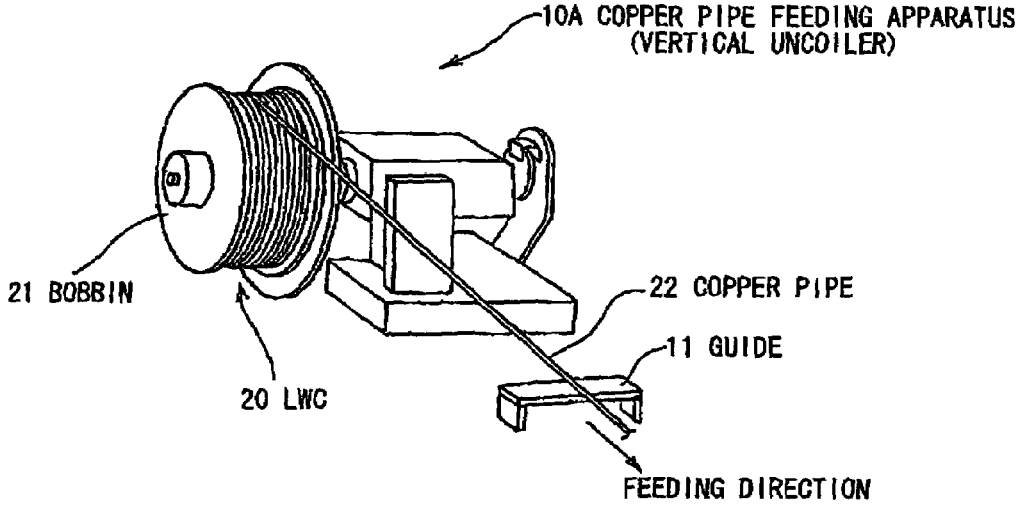
FIG. 15A PRIOR ART
FIG. 15A is a perspective view showing the conventional copper pipe feeding apparatus (vertical uncoiler)
Figure 15B:
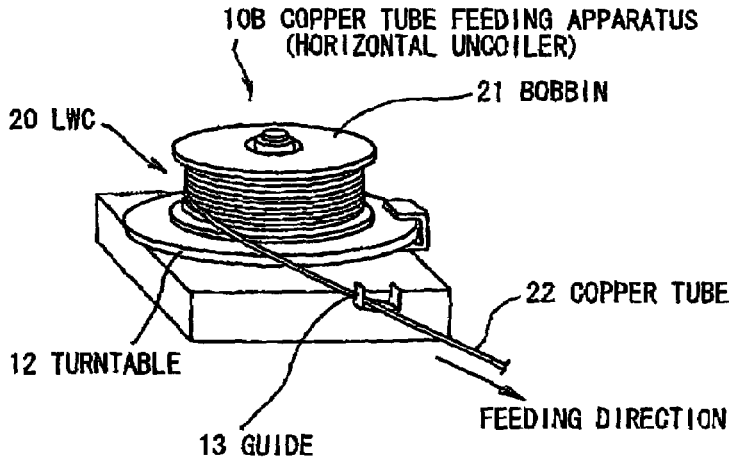
FIG. 15B PRIOR ART
FIG. 15B is a perspective view showing the conventional copper pipe feeding apparatus (horizontal uncoiler)
Figure 16:
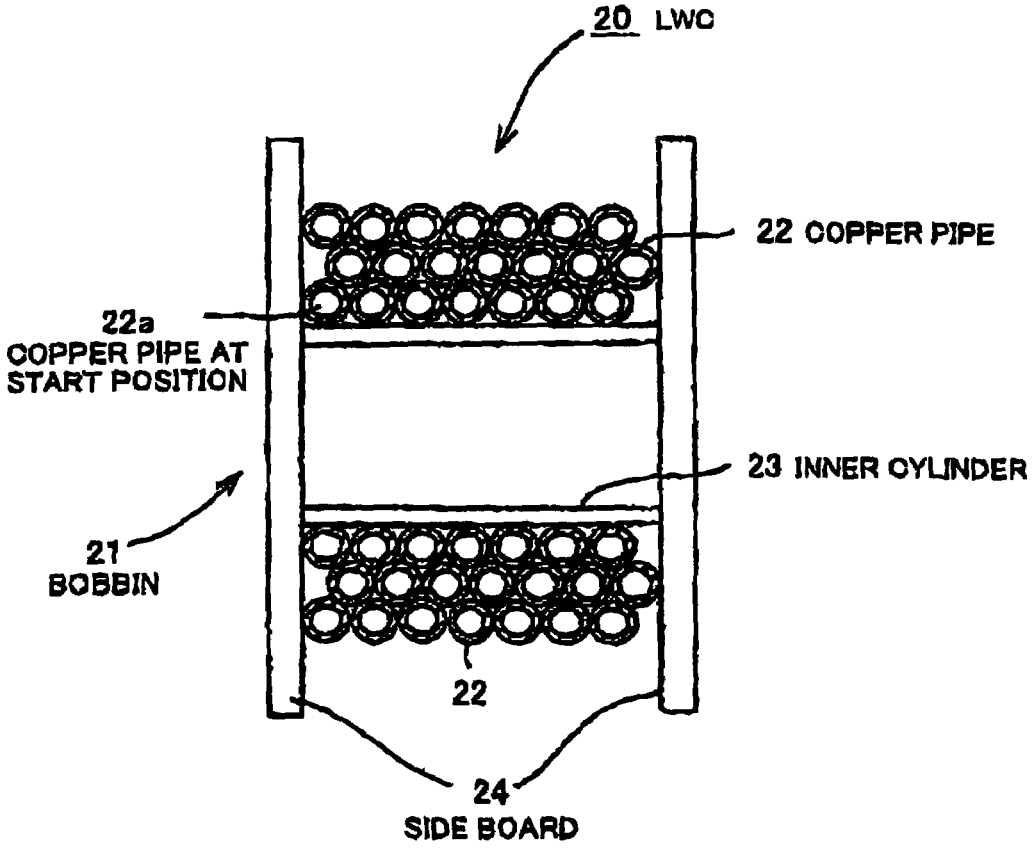
FIG. 16 PRIOR ART
FIG. 16 is a schematic cross sectional view showing a detailed arrangement of an LWC coiled around a bobbin in FIG. 15A or 15B.
Figure 17:
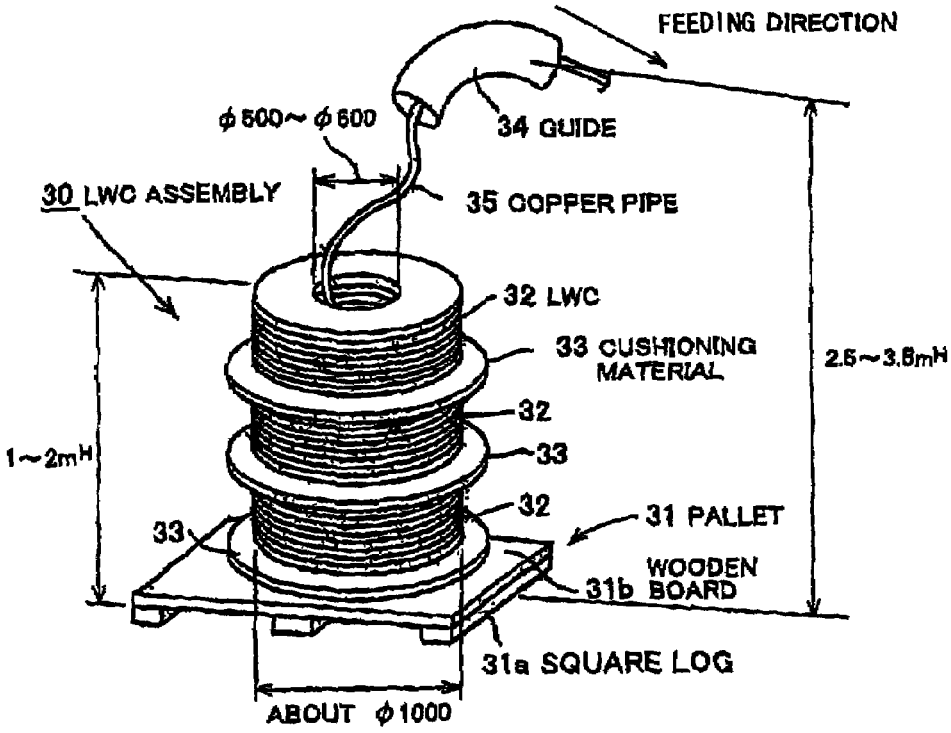
FIG. 17 PRIOR ART
FIG. 17 is a perspective view showing a method of feeding a copper pipe by the ETTS method.
Figure 18:
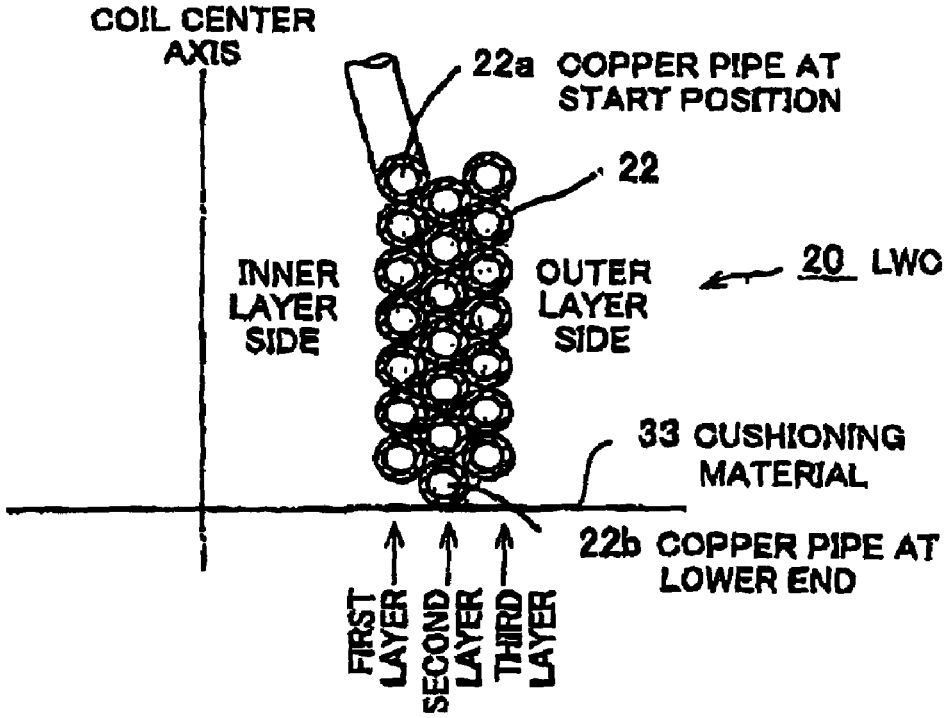
FIG. 18 PRIOR ART
FIG. 18 is a schematic cross sectional view illustrating an uncoiling method in LWC.
Figure 19:
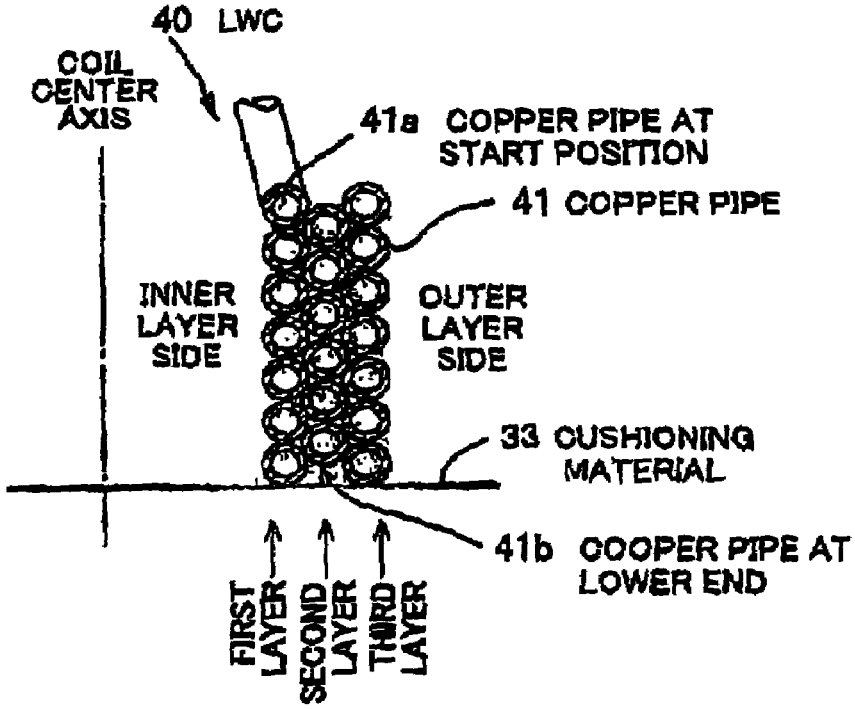
FIG. 19 PRIOR ART
FIG. 19 is a schematic cross sectional view illustrating an uncoiling method to facilitate the feeding of a copper pipe at lower end.
Figure 20:
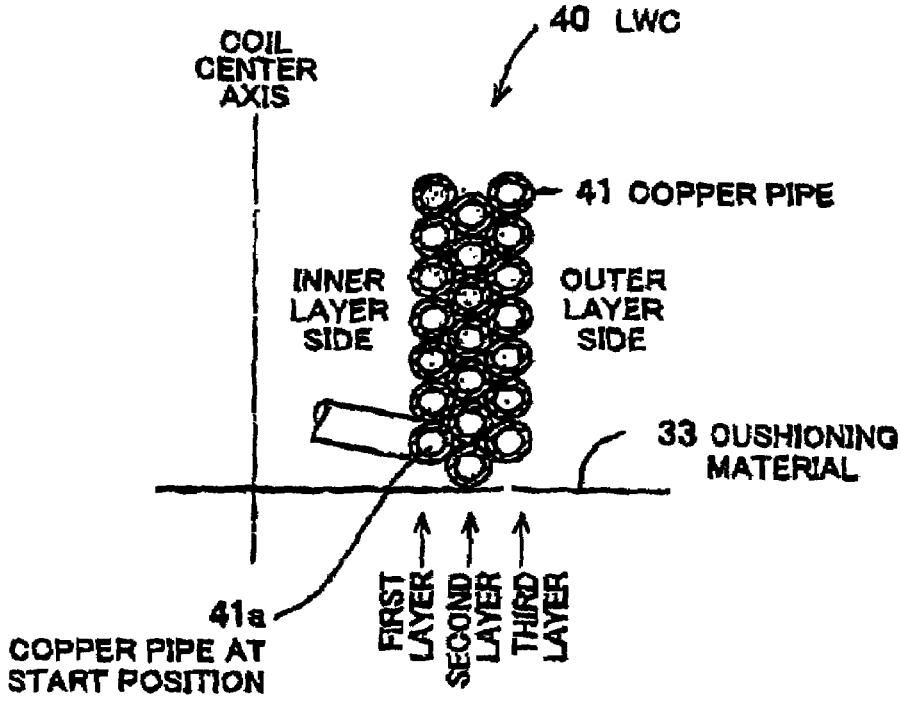
FIG. 20 PRIOR ART
FIG. 20 is a schematic cross sectional view illustrating another uncoiling method to facilitate the feeding of a copper pipe at lower end.
Figure 21B:
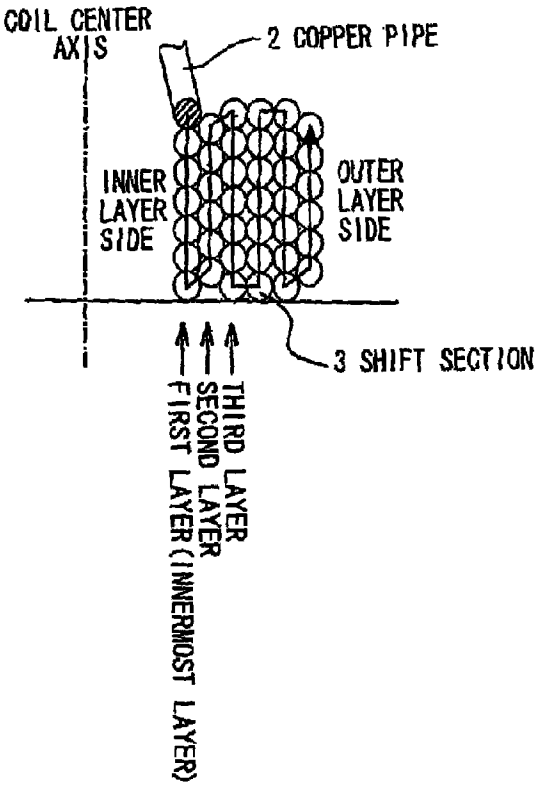
FIG. 21B PRIOR ART
FIG. 21B is a schematic cross sectional view illustrating a portion with a shift section in LWC.
Figure 21A:
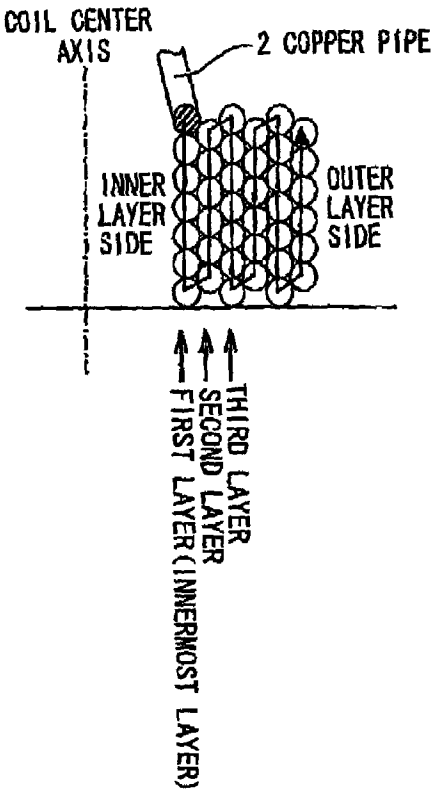
FIG. 21A PRIOR ART
FIG. 21A is a schematic cross sectional view illustrating a portion without a shift section in LWC.

FIG. 14B is a top view (above) showing a spacer in the preferred embodiment of the invention and cross sectional views (below) cut along a line B1-B1 or a line B2-B2 thereof.

As shown in FIG. 14B, the spacer 54B is provided with a recessed area 55$B_2$ at a portion partially corresponding to face the shift section. Also, the spacer 54B is provided with a recessed area 55$B_1$ formed regardless of the portion where to face the shift section. The recessed area 55$B_1$ can be used as a groove where the fixing band for the LWC assembly is passed through.

Modified Embodiment

When the LWC is stacked directly on the pallet, the pallet can have a recessed area formed as described above. This embodiment can have the same effects as in the above embodiments.

Package for LWC Mounted on Pallet

The package in a preferred embodiment of the invention has a composition similar to that disclosed in JP-A-2002-370869. Namely, the periphery of the LWC mounted on pallet as described in the above embodiments is covered with a protecting and fixing means such as a resin film for the protection and fixation during the transportation to obtain the package. For example, the resin film is suitably of polyethylene.

Method of Manufacturing the Package

The package for the LWC mounted on pallet of the invention can be manufactured by the conventional method, e.g., as disclosed in JP-A-2002-370869. However, it is different from the conventional package in the arrangement of the shift section formed at the bottom of the LWC and the structure of the spacer (=cushioning material) on which the LWC is stacked. Thereby, the pipe trapping at the shift section can be significantly reduced.

Example 1

An example of the invention will be described below.

Using copper pipes with different dimensions (in outer diameter and average wall thickness), the tempered LWC (of annealed material (temper designation; annealed temper, e.g.

JIS H 3300 C1020 T-OL and JIS H 3300 C1220 T-OL)) is made such that it has substantially the same inner diameter, height and weight. The LWC is mounted on the pallet through the spacer. The feeding test by the ETTS is conducted to each LWC.

The winding (=control of the arrangement of the shift section) of LWC is in the form of a combination of the arrangements as shown in FIG. 1 (or FIG. 2) and FIG. 3. The material of the copper pipe is oxygen-free copper (JIS H 3300 C1020, ASTM B111 C10200) and phosphorus deoxidized copper (JIS H 3300 C1220, ASTM B111 C12200) which are nearly equal in physical or mechanical properties (e.g., density, Young's modulus, and tensile strength)

Figure 22:
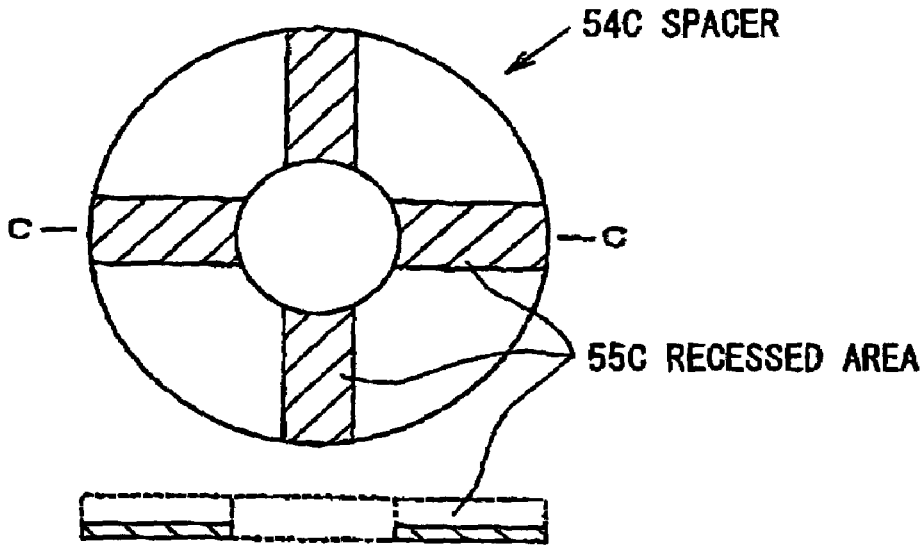
FIG. 22 is a top view (above) showing a spacer in a comparative example and a cross sectional view (below) cut along a line C-C thereof.

The spacer is formed by laminating three about 3 mm-thick B-flute both-sided cardboards (each of which is composed of top face (craft liner): K180, corrugating medium (semi-craft pulp): SCP120, and back face (craft liner): K180). Before the three B-flute both-sided cardboards are laminated together, each B-flute both-sided cardboard corresponding to the top one or two boards of the laminate is cut to obtain the spacer formed as shown in FIGS. 12A, 14A and 14B. A spacer in comparative example is made such that it is, as shown in FIG. 22, provided with a recessed area 55C formed regardless of being faced to the shift section, for the same test.

The common conditions are as shown in Table 1 and the test results are as shown in Table 2. The maximum reflections in Table 2 are values calculated by using the curvature radius $R_{out}$ of the outermost-layer pipe of LWC in place of $R_k$* in formula (1).

TABLE 1

<Common conditions>

| Item | Unit | Condition |
|---|---|---|
| Inner diameter of LWC | m | 0.56 |
| Height of LWC | m | 0.32-0.33 |
| Weight of LWC | Kg | $2.3 \times 10^2$ |
| Density ρ of material (C1020, C1220) | $kg/m^3$ | $8.9 \times 10^3$ |
| Gravity acceleration | $m/s^2$ | 9.8 |
| Young's modulus E of pipe material (*) | Pa | $1.15 \times 10^{11}$ |
| Feeding rate of copper pipe | m/s | 1 |

(*) Reference: Metals Handbook Ninth Edition, vol. 2, American Society for Metals, OH, US (1979) p. 275.

TABLE 2

<Test results>

| Sample No. | Copper pipe outer diameter [mm] | Average wall thickness [mm] | Moment of inertia of area [$mm^4$] | Curvature radius of LWC outermost layer $R_{OUT}$ [m] | Form of spacer | Sector angle of recessed area [rad] | Level difference of recessed area [mm] | Amount of maximum deflection [mm] | Cumulative incidence number of pipe trapping |
|---|---|---|---|---|---|---|---|---|---|
| 1 | 5 | 0.25 | 11 | 0.47 | FIG. 12A type | 1.05 | about 3 | 0.042 | 0 |
| 2 | | | | | FIG. 14A type | 1.57 | about 3 | 0.21 | |
| 3 | | | | | FIG. 14B type | 1.92 | about 3 | 0.47 | |
| 4 | | | | | FIG. 22 type | — | — | — | 15 |
| 5 | 6.35 | 0.29 | 25 | 0.48 | FIG. 12A type | 1.05 | about 3 | 0.028 | 0 |
| 6 | | | | | FIG. 14A type | 1.57 | about 3 | 0.14 | |
| 7 | | | | | FIG. 14B type | 1.92 | about 3 | 0.32 | |
| 8 | | | | | FIG. 22 type | — | — | — | 13 |
| 9 | 7 | 0.29 | 34 | 0.50 | FIG.12A type | 1.05 | about 3 | 0.027 | 0 |
| 10 | | | | | FIG. 14A type | 1.57 | about 3 | 0.14 | |
| 11 | | | | | FIG. 14B type | 1.92 | about 3 | 0.31 | |
| 12 | | | | | FIG. 22 type | — | — | — | 12 |
| 13 | 7 | 0.33 | 39 | 0.48 | FIG. 12A type | 1.05 | about 3 | 0.023 | 0 |
| 14 | | | | | FIG. 14A type | 1.57 | about 3 | 0.12 | |
| 15 | | | | | FIG. 14B type | 1.92 | about 3 | 0.26 | |
| 16 | | | | | FIG. 22 type | — | — | — | 5 |
| 17 | 8 | 0.32 | 57 | 0.51 | FIG. 12A type | 1.05 | about 3 | 0.022 | 0 |
| 18 | | | | | FIG. 14A type | 1.57 | about 3 | 0.11 | |
| 19 | | | | | FIG. 14B type | 1.92 | about 3 | 0.25 | |
| 20 | | | | | FIG. 22 type | — | — | — | 6 |
| 21 | 9.52 | 0.34 | 103 | 0.52 | FIG. 12A | 1.05 | about | 0.017 | 0 |

TABLE 2-continued

<Test results>

| Sample No. | Copper pipe outer diameter [mm] | Average wall thickness [mm] | Moment of inertia of area [$mm^4$] | Curvature radius of LWC outermost layer $R_{OUT}$ [m] | Form of spacer | Sector angle of recessed area [rad] | Level difference of recessed area [mm] | Amount of maximum deflection [mm] | Cumulative incidence number of pipe trapping |
|---|---|---|---|---|---|---|---|---|---|
| | | | | | type | | 3 | | |
| 22 | | | | | FIG. 14A type | 1.57 | about 3 | 0.087 | |
| 23 | | | | | FIG. 14B type | 1.92 | about 3 | 0.19 | |
| 24 | | | | | FIG. 22 type | — | — | — | 3 |
| 25 | 12.7 | 0.39 | 286 | 0.55 | FIG. 12A type | 1.05 | about 3 | 0.012 | 0 |
| 26 | | | | | FIG. 14A type | 1.57 | about 3 | 0.061 | |
| 27 | | | | | FIG. 14B type | 1.92 | about 3 | 0.14 | |
| 28 | | | | | FIG. 22 type | — | — | — | 3 |

As the result of the pipe feeding test by the ETTS method, no pipe trapping phenomenon (a kink and/or plastic buckling) happens in sample Nos. 1-3, 5-7, 9-11, 13-15, 17-19, 21-23 and 25-27 each of which satisfies formula (1). In contrast, plural pipe trappings during the pipe feeding happen in sample Nos. 4, 8, 12, 16, 20, 24 and 28 each of which uses the spacer without the recessed area at a portion (at least a portion to face the axis-direction non-shift section) to face the shift section. Herein, the pipe trapping means that the feeding of a pipe is stuck or stopped because the supply of the pipe is blocked by some reason.

The test results suggest strongly that the pipe trapping during the pipe feeding by the ETTS method can be prevented effectively by the control of the winding of the LWC copper pipe and the form of the cushioning material (=spacer) for stacking the LWC thereon according to the invention.

Example 2

The LWC assembly (=LWC mounted on pallet) with plural LWC's stacked in the above embodiments is manufactured and evaluated in feeding easiness (number of pipe trapping).

The average weight of each LWC is 160 kg, and the test is conducted to the LWC assembly with three LWC's stacked. The copper pipe is 7 mm in outer diameter, 0.25 mm in average wall thickness, an inner grooved pipe of phosphorus deoxidized copper (hereinafter simply called copper pipe). The winding of the copper pipe (i.e., the control of the arrangement of the shift section), degree of tempering, and spacer are prepared the same as Example 1 in conducting the feeding test. The form of the spacer is as shown in FIG. 14B, and the spacer is inserted directly under each LWC.

As the result of the feeding test in Example 2, no pipe trapping happens. Thus, it is confirmed that the control of the winding of the LWC copper pipe and the form of the cushioning material (=spacer) for mounting the LWC thereon according to the invention is also effective in the LWC mounted on pallet (=LWC assembly with plural LWC's stacked).

In general, when the pipe trapping phenomenon happens during the feeding of copper pipe, a cutter has to be stopped to remove the pipe trapping and then to be restarted. However, in the invention, since no pipe trapping phenomenon happens, the operation can be conducted efficiently.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A level wound coil (LWC)-mounting pallet, comprising: a pallet; and an LWC comprising a plurality of coil layers each of which comprises a pipe wound in alignment winding and in traverse winding, a coil of a (m+1)-th coil layer being located such that a pipe at a start position thereof is fitted into a concave part formed between a pipe at a lower end and its adjacent pipe of a m-th coil layer outside of the m-th coil layer, where, when the LWC is disposed on a mount surface perpendicular to a coil center axis of the LWC, m is an odd natural number if a start position of the winding of the LWC is located at the upper end and m is an even natural number if the start position is located at the lower end;

wherein the one or more LWC is mounted directly on the pallet or through a cushioning material on the pallet, wherein the LWC comprises a shift section where the pipe is shifted from the m-th coil layer to the (m+1)-th coil layer on a bottom surface thereof when the LWC is disposed on the mount surface, wherein the shift section comprises a k-th shift section on an inner layer side and a (k+1)-th shift section on an outer layer side, where k is a natural number, and a start point of the (k+1)-th shift section does not transit, relative to a start point of the k-th shift section, in a reverse direction to a winding direction of the pipe, and wherein the pallet or the cushioning material comprises a recessed area that is formed at all or a part of a portion of the pallet or the cushioning material to face the (k+1)-th shift section not transiting in the reverse direction.

2. The LWC-mounting pallet according to claim 1, wherein:

the recessed area faces the (k+1)-th shift section at least at an axis-direction non-shift section that the pipe does not transit to a direction of the coil center axis.

3. A package for the LWC-mounting pallet as defined in claim 2, comprising:

a protecting and/or fixing means that covers a periphery of the LWC mounted on the pallet.

4. The LWC-mounting pallet according to claim 1, wherein:

the recessed area is formed corresponding to only an outer layer than the middle of all layers in the LWC.

5. A package for the LWC-mounting pallet as defined in claim 4, comprising:

a protecting and/or fixing means that covers a periphery of the LWC mounted on the pallet.

6. The LWC-mounting pallet according to claim 1, wherein:

the recessed area is formed to make the pallet or the cushioning material not to be in contact with the pipe at the recessed area when the LWC is disposed on the mount surface perpendicular to the coil center axis thereof.

7. A package for the LWC-mounting pallet as defined in claim 6, comprising:

a protecting and/or fixing means that covers a periphery of the LWC mounted on the pallet.

8. The LWC-mounting pallet according to claim 1, wherein:

the recessed area comprises, at a position where to face the k-th shift section, a level difference between the recessed area and non-recessed area $G_k$[m] to satisfy formula (1):

$$G_k \geq 0.2\frac{\rho(R_k^*\phi)^4}{E\{(d-t)^2+t^2\}} \tag{1}$$

where ρ[kg/m$^3$] is a density of a material of the pipe, $R_k$*[m] is a half of an outside winding diameter of the pipe at just before a start point of the k-th shift section, φ[rad] is a sector angle of the recessed area viewed from the coil center axis, E[Pa] is Young's modulus of the material of the pipe, d[m] is an outer diameter of the LWC pipe, and t[m] is an average wall thickness of the pipe.

9. A package for the LWC-mounting pallet as defined in claim 8, comprising:

a protecting and/or fixing means that covers a periphery of the LWC mounted on the pallet.

10. A package for the LWC-mounting pallet as defined in claim 1, comprising:

a protecting and/or fixing means that covers a periphery of the LWC mounted on the pallet.

* * * * *